US006438352B1

(12) United States Patent
Landa et al.

(10) Patent No.: US 6,438,352 B1
(45) Date of Patent: Aug. 20, 2002

(54) PRINTING SYSTEM

(75) Inventors: Benzion Landa, Nes-Ziona; Josef Rosen, Moshav-Sitriya, both of (IL)

(73) Assignee: Indigo N.V., Maastricht (NL)

( * ) Notice: Subject to any disclaimer, the term of this patent is extended or adjusted under 35 U.S.C. 154(b) by 0 days.

(21) Appl. No.: 09/701,049

(22) PCT Filed: Nov. 11, 1998

(86) PCT No.: PCT/IL98/00553

§ 371 (c)(1),
(2), (4) Date: Nov. 22, 2000

(87) PCT Pub. No.: WO99/61958

PCT Pub. Date: Dec. 2, 1999

Related U.S. Application Data

(63) Continuation of application No. PCT/IL98/00235, filed on May 24, 1998.

(51) Int. Cl.[7] ..... G03G 15/23

(52) U.S. Cl. ..... 399/401; 101/230; 399/364

(58) Field of Search ..... 399/401, 364, 399/303, 304, 306; 101/229, 230, 231, 262, 296; 271/277, 291, 301; 400/188

(56) References Cited

U.S. PATENT DOCUMENTS

| | | | | |
|---|---|---|---|---|
| 3,734,015 A | | 5/1973 | Camis et al. | 101/229 |
| 3,741,643 A | | 6/1973 | Smith et al. | 399/249 |
| 4,165,689 A | | 8/1979 | Giuiuzza | 101/230 |
| 4,186,662 A | | 2/1980 | Borneman | 101/218 |
| 4,202,268 A | | 5/1980 | Becker | 101/409 |
| 4,204,471 A | | 5/1980 | Becker | 101/410 |
| 4,204,472 A | | 5/1980 | Borneman | 101/230 |
| 4,375,326 A | | 3/1983 | Lang | 399/401 |
| 4,378,734 A | * | 4/1983 | Wirz | 101/230 |
| 4,428,667 A | | 1/1984 | Phelps et al. | 399/372 |

(List continued on next page.)

FOREIGN PATENT DOCUMENTS

| | | |
|---|---|---|
| DE | 196 35 388 | 5/1998 |
| EP | 0 161 522 | 11/1985 |
| EP | 0 274 989 | 7/1988 |
| EP | 0 311 924 | 4/1989 |
| EP | 0 312 660 | 4/1989 |
| EP | 0 435 164 | 7/1991 |
| EP | 0 342 704 | 8/1993 |
| EP | 0 562 269 | 9/1993 |
| EP | 0 570 786 | 11/1993 |
| FR | 2 358 273 | 2/1978 |
| WO | WO 90/04216 | 4/1990 |
| WO | WO 93/01531 | 1/1993 |
| WO | WO 93/04409 | 3/1993 |
| WO | WO 94/23347 | 10/1994 |
| WO | WO 95/10801 | 4/1995 |
| WO | WO 96/17277 | 6/1996 |
| WO | WO 97/07433 | 2/1997 |

OTHER PUBLICATIONS

Fuji Photo Film Co. LTD.; JP 63–094287 A; Apr. 25, 1988 & Patent Abstracts of Japan; vol. 012; No. 331 (P–755); Sep. 7, 1988.

(List continued on next page.)

*Primary Examiner*—Sophia S. Chen
(74) *Attorney, Agent, or Firm*—Fenster & Company Patent Attorneys, Ltd.

(57) ABSTRACT

Duplex printing apparatus for printing on two sides of a sheet, the apparatus including:

an expression roller on which the sheet is held during printing;

a imager which prints an image on a first side of the sheet while it is being held on the impression roller; and a sheet inverter which removes the sheet from the impression roller, inverts the sheet and returns it to the impression roller for printing on a second side of the sheet by imager, wherein the sheet it to held on said impression roller referenced to a first edge thereof during the printing of the first side thereof and is also held on the impression roller referenced to said first edge during printing of the second side thereof.

58 Claims, 16 Drawing Sheets

U.S. PATENT DOCUMENTS

| | | | | | |
|---|---|---|---|---|---|
| 4,431,303 | A | | 2/1984 | Hoffman | 399/401 |
| 4,568,169 | A | | 2/1986 | Wada et al. | 399/401 |
| 4,607,940 | A | | 8/1986 | Quang | 399/88 |
| 4,621,576 | A | | 11/1986 | Wirz | 101/230 |
| 4,639,126 | A | | 1/1987 | Bushaw et al. | 399/364 |
| 4,684,238 | A | | 8/1987 | Till et al. | 399/308 |
| 4,721,041 | A | * | 1/1988 | Simeth | 101/230 |
| 4,723,489 | A | * | 2/1988 | Emrich et al. | 101/230 |
| 4,806,079 | A | | 2/1989 | Kuhn | 417/343 |
| 4,814,822 | A | | 3/1989 | Acquaviva et al. | 399/204 |
| 4,821,643 | A | | 4/1989 | Wieland | 101/230 |
| 4,884,794 | A | | 12/1989 | Dinatale et al. | 271/3.19 |
| 4,949,949 | A | | 8/1990 | Holmes et al. | 271/3.03 |
| 4,967,660 | A | * | 11/1990 | Yamanari et al. | 101/229 |
| 4,974,027 | A | | 11/1990 | Landa et al. | 399/249 |
| 5,003,355 | A | | 3/1991 | Tanzawa | 399/401 |
| 5,020,788 | A | | 6/1991 | Hatano et al. | 271/126 |
| 5,110,159 | A | | 5/1992 | Herold et al. | 285/121.5 |
| 5,170,211 | A | | 12/1992 | Haupt et al. | 399/93 |
| 5,439,029 | A | | 8/1995 | Becker | 137/590 |
| 5,552,875 | A | | 9/1996 | Sagiv et al. | 399/364 |
| 5,710,964 | A | * | 1/1998 | Tombs et al. | 399/303 |
| 5,772,343 | A | * | 6/1998 | Beretta et al. | 399/401 X |

OTHER PUBLICATIONS

Hitachi Koki Co. LTD.; JP 03–179470 A; Aug 5 1991 & Patent Abstracts of Japan; vol. 015; No. 433 (P–1271); Nov. 5 1991.

Canon Inc.; JP 53–010441 A; Jan 30 1978 & Patent Abstracts of Japan; vol. 002; No. 045 (E–024); Mar. 27 1978.

* cited by examiner

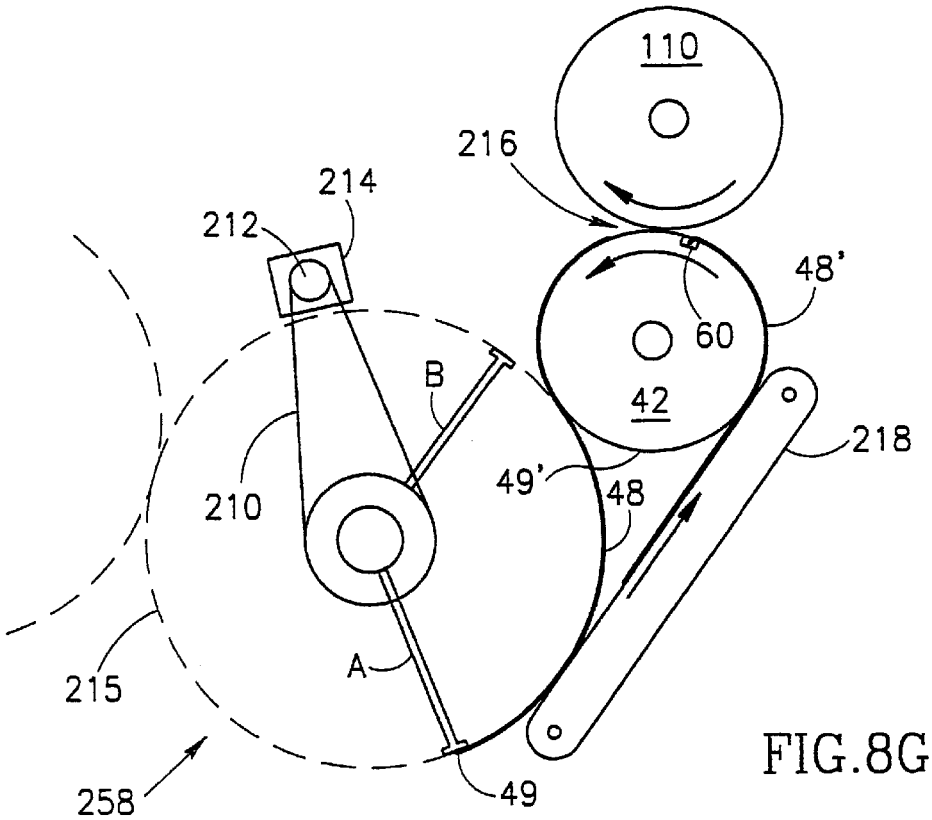
FIG.8G
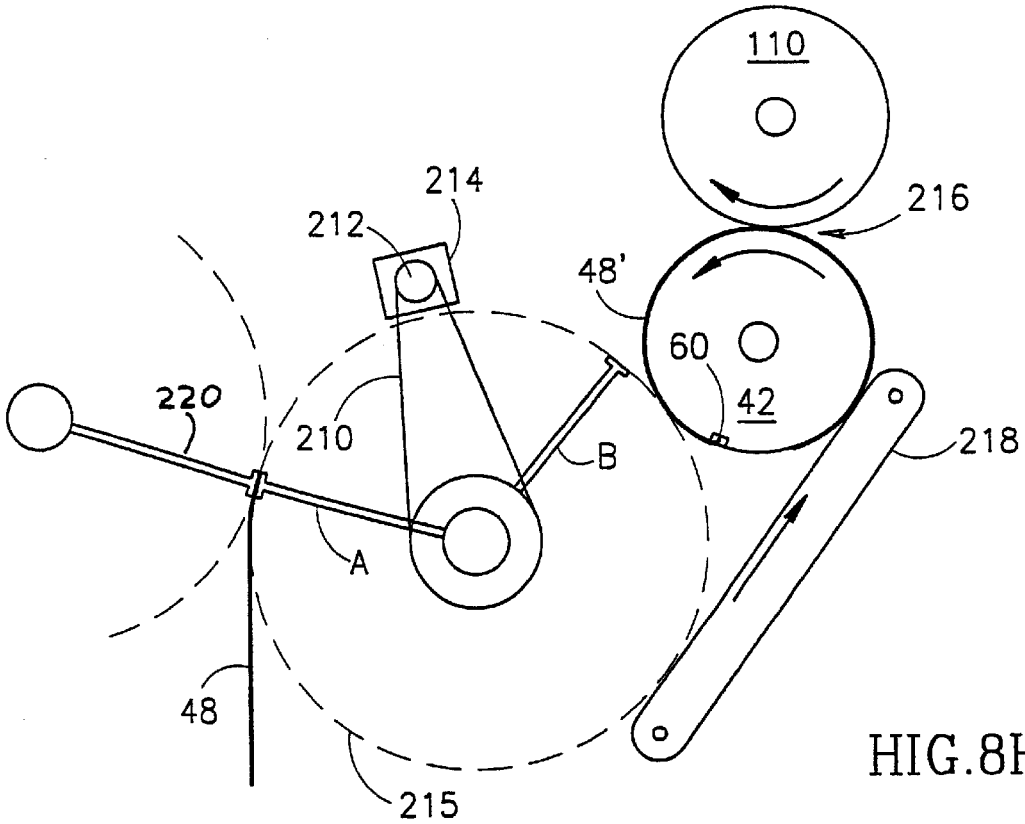
HIG.8H

PRINTING SYSTEM

RELATED APPLICATION

The present application is a U.S. national stage application of PCT/IL98/00553, filed Nov. 11, 1998, and a continuation of PCT/IL98/00235, filed May 24, 1998.

FIELD OF THE INVENTION

The present invention relates generally to printing systems and more particularly to duplex printing systems for printing variable information on one or both sides of a sheet.

BACKGROUND OF THE INVENTION

Apparatus for duplex copying of documents and for duplex printing by means of laser printers are known in the art. U.S. Pat. No. 4,949,949 to Holmes et al. describes a "Hybrid Sequencing Duplex Automatic Document Handling System" which includes apparatus for handling document sheets both sides of which are to be copied and for making duplex (i.e. double-sided) copies of such document sheets. The apparatus involve the use of one or more pairs of reversible rollers, lengthy inversion paths, and buffer trays for the handling of the documents and the copy paper prior to and in the course of making duplex copies. U.S. Pat. No. 4,884,794 to Dinatale et al. describes a document handler for duplex photocopying having first and second inverting path segments, which are utilized to re-orient the copy paper prior to duplex copying. U.S. Pat. No. 5,003,355 to Tanzawa describes a sheet transport control apparatus for use in a duplex unit of a laser printer, the apparatus including a transport system and a switchback system, and a series of driving motors and sensors. All these systems described in the prior art share the common feature of being mechanically complex, and they all involve transporting the paper through relatively lengthy and convoluted paths after printing on the first side so as to be able to print on the second side. Other systems for duplex printing are described in U.S. Pat. Nos. 4,806.079; 4,814,822; 4,568,169; 4,639,126; 4,428,667; 4,607,940; 4,375,326 and 5,020,788 and EP publication 0342704.

PCT publication 93/04409 describes a switchback system with a much shorter path than older systems, which allowed for on demand duplex printing without storage of large numbers of sheets.

Systems which utilize the same impression roller and/or the same printing engine for printing both sides of a web are known in the art. However, even in those systems the two sides of the web are printed at different printing positions in the printer and the web is not indexed at an edge.

Also known are systems for reversing sheets between printing stations. One such system is called a "perfecta" type system and comprises a roller that acts to turn over the sheet. Such systems, unlike those used for laser printers, reference the printing sheet from the same edge for printing on both sides.

A prior art perfecta system 10 is shown in FIGS. 1A and 1B. This system comprises a first impression roller 12, which holds a sheet 14 for printing thereon by a print roller (not shown). Sheet 14 is transferred to roller 16 where it is held by a front edge clamp 20. Roller 16 continues to rotate and the front edge of sheet 14 passes an inverting roller 18. When the trailing edge reaches inverting roller 18, a clamp 20 on roller 18 catches the trailing edge of sheet 14 and, as shown in FIG. 1B inverts the sheet prior to its being clamped to a second impression roller 22.

An advantage of perfecta systems is that while the leading edge for printing the first and second sides of the sheet are reversed, the same edge is used as a reference position for printing both sides. Another advantage of perfecta systems, which is related to the first advantage, is that the sheets are always positively held by the system during inversion of the sheet. Positive holding of sheets distinguishes "perfecta" systems from systems which utilize a single printing engine and which generally do not positively hold the sheets during the entire process of transfer and reversal.

However, inverting systems which provide the advantages of perfecta systems are not known in a printer using the same impression roller and printing engine for printing both sides of the sheet.

SUMMARY OF THE INVENTION

One aspect of some preferred embodiments of the present invention provides apparatus and a method for duplex printing of sheets, utilizing the same edge of the sheet for reference for printing both sides thereof, while utilizing the same impression roller and/or the same printing engine.

One aspect of some preferred embodiments of the present invention provides apparatus and a method for duplex printing of sheets utilizing an impression roller for printing both sides of a sheet, while positively holding the sheet during the entire process of reversal and transfer of the sheet. Preferably, this means that the sheet is positively held from the start of the printing process to its end.

In a preferred embodiment of the invention only one sheet, other than a sheet held in the impression roller is in the inverting system.

In a preferred embodiment of the invention, the same set of one or more printing engines is used in the printing of both sides of all the sheets.

In preferred embodiments of the present invention a perfecta-like system is used. This system includes rollers and/or belts which receive the sheet from one position on the circumference of an impression roller and, after reversing the sheet. delivers the sheet to a second position on the impression roller. Preferably, the path traveled by the sheet between the two positions holds an integral number of sheets. Preferably, the impression roller holds a plurality of sheets and presents them seriatim to one or more print engines. Preferably, the engine or engines are electrographic or other engines providing programmable images such as electrophotographic engines, ink or bubble jet print heads thermal printing heads or any other suitable printing engines.

Other aspects of some preferred embodiments of the invention are concerned with high speed printing engines, especially with high speed electrographic printing engines. In such engines special care must be taken in charging a photoreceptor and, when liquid toner is utilized, in treating and transport of the image. Some aspects of some preferred embodiments of the present invention deal with improvements in such engines especially useful for high speed printing.

There is thus provided, in accordance with a preferred embodiment of the invention duplex printing apparatus for printing on two sides of a sheet, the apparatus comprising:

an impression roller on which the sheet is held during printing;

imager which prints an image on a first side of the sheet while it is being held on the impression roller; and a sheet inverter which removes the sheet from the impression roller, inverts the sheet and returns it to the impression roller for printing on a second side of the sheet by the imager, wherein the sheet is held on said impression roller referenced to a first edge thereof during the printing of the first side thereof and is also held on the impression roller referenced to said first edge during printing of the second side thereof.

Preferably, the sheet inverter positively controls the position of the sheet during the inversion thereof, without releasing the sheet during the inversion.

There is further provided, in accordance with a preferred embodiment of the invention a duplex printing apparatus for printing on two sides of a sheet, the apparatus comprising:

a surface, on which an image to be printed is selectably formed;

an impression roller on which the sheet is held during printing, referenced to a first edge thereof;

an imager which prints an image on a first side of the sheet while it is being held on the impression roller; and a sheet inverter which removes the sheet from the impression roller, inverts the sheet and returns it to the impression roller for printing on a second side of the sheet by the imager, wherein the sheet inverter positively controls the position of the sheet from the removal of the sheet from the impression roller to the return of the sheet thereto after the inversion thereof, without releasing the sheet.

in a preferred embodiment of the invention the sheet inverter comprises:

a paper pick-off system which removes the sheet from the impression roller, after printing of the first side of the sheet, while the sheet is held referenced to said first edge;

an inverting transport past which the first edge is carried while the sheet remains referenced to said first edge; and a sheet pick-off on said inverting transport which captures a second edge of the sheet, opposite the first edge while the sheet is still being held referenced to the first edge, such that said capture is made referenced to the first edge, said inverting transport transporting the second edge to the impression roller for capture by the impression roller, such that the second side of the sheet is presented for printing by the imager.

Preferably, the apparatus includes at least one intermediate transport which receives the sheet from the sheet pick-off system and transports it to the inverting transport while the sheet remains referenced to the first edge. Preferably, the at least one intermediate transport comprises at least one roller. Preferably, a sheet path in the paper pick-off, sheet pick-off and intermediate transport is at least the length of a plurality of sheets.

In a preferred embodiment of the invention, the inverting transport comprises a transport roller.

Preferably, the page inverter comprises a perfecta system.

In a preferred embodiment of he invention, the page inverter stops the motion of the sheet while positively holding it referenced to the printing on the first side and then moves the sheet in a reverse direction for capture by the impression roller.

Preferably, the paper pick-off comprises at least one vacuum pick-off that picks the sheet off the impression roller and holds it while it is being inverted. Preferably, the at least one vacuum pick-off comprises two sets of vacuum pick-offs each comprising at least one pick-off, wherein the vacuum pick-offs pick offs alternate in picking sheets off the impression roller.

Preferably, the apparatus includes a belt transport that receives a sheet from the at least one vacuum pick-off and transports it to the impression roller while positively holding the sheet referenced to the image printed on the first side.

Preferably, the vacuum pick-offs rotate about an axis and have a radial extent from the axis and the apparatus has at least one at least partial disk concentric with the axis and the disk has a radial extent equal to the radial extent of the vacuum pick-offs.

In a preferred embodiment of the invention, the impression roller and the inverting system hold no more than two sheets at any one time.

Preferably, the imager comprises a plurality of imaging stations each of which transfers an image of a different color to the sheet.

In a preferred embodiment of the invention, the imager includes an image forming surface on which the image is formed prior to transfer to the sheet. Preferably, the imager includes at least one intermediate transfer member to which images are transferred from the image forming surface and from which the images are transferred to the sheet.

In a preferred embodiment of the invention the imager provides different images to the sides of the sheet.

According to one preferred embodiment of the invention the imager is an electrographic imager.

The imager can be a powder toner imager or a liquid toner imager.

The imager can be an ink-jet or bubble jet imager.

In a preferred embodiment of the invention the impression roller is adapted to hold a plurality of sheets at one time.

There is further provided, in accordance with a preferred embodiment of the invention, a duplex printing method for printing on two sides of a sheet, the method comprising:

printing an image on a first side of the sheet at a printing position, the sheet and thus said printing being referenced to an edge of the sheet;

inverting the sheet and returning it to the printing position while it remains referenced to said edge; and printing an image on a second side of the sheet at said printing position while the sheet and thus said printing is referenced to said edge.

Preferably, the position of the sheet is positively controlled during inversion thereof, without releasing the sheet between printing of the first and second sides thereof.

There is further provided, in accordance with a preferred embodiment of the invention a duplex printing method for printing on two sides of a sheet, the method comprising:

printing an image on a first side of the sheet at a printing position;

inverting the sheet and returning it to the printing position; and printing an image on a second side of the sheet at said printing position, wherein the position of the sheet is positively controlled during printing and inversion thereof, without releasing the sheet.

Preferably, the sheet is delivered to said printing position by a moving member on which it is held while being referenced to said edge.

In a preferred embodiment of the invention the sheet is printed while being moved by the moving surface, past the printing position and wherein the sheet is held at said edge during printing of one side thereof and held by an opposite edge of the sheet during printing of the other side thereof.

Preferably, the sheet is printed while being moved past the printing position with said edge passing the position first during printing of one side of the sheet and wherein said edge passes the printing position after the rest of the sheet during the printing of the other side of the sheet.

Preferably the method includes printing different images on the two sides of the sheet.

In a preferred embodiment of the invention, inverting the sheet includes:

moving the sheet to a first position while holding it referenced to the first edge; and stopping it at the first position: and returning it to the printing position while it remains referenced to the first edge.

BRIEF DESCRIPTION OF THE DRAWINGS

The present invention will be more completely understood and appreciated from the following detailed description of preferred embodiments of the invention, taken in conjunction with the drawings. Corresponding structures in different drawings are indicated with the same reference numeral. The drawings are:

FIGS. 8A–8H schematically shows the progress of sheets in the preferred embodiment of FIG. 6;

DETAILED DESCRIPTION OF PREFERRED EMBODIMENTS

Figure 1A:
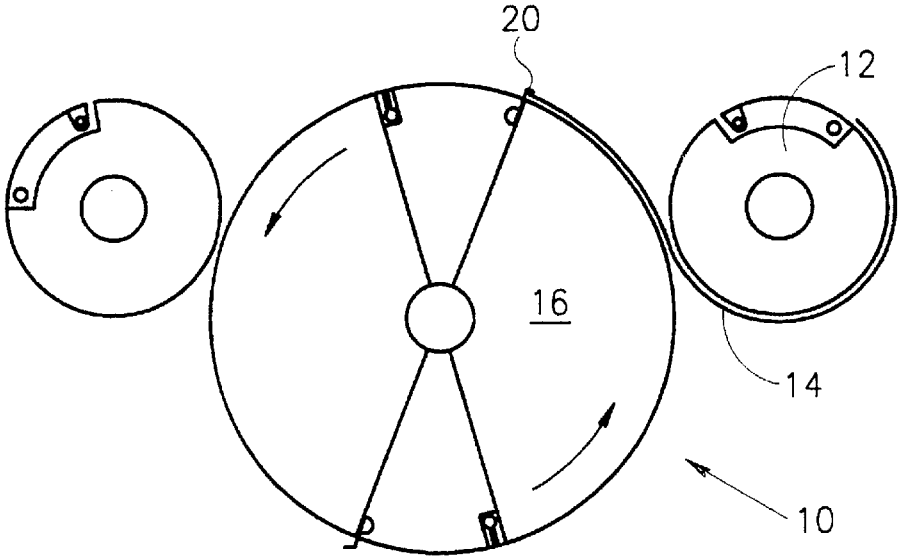
FIG. 1A PRIOR ART
FIGS. 1A and 1B illustrate schematically a prior art multi-station (multi-impression roller) duplex printing apparatus.
Figure 1B:
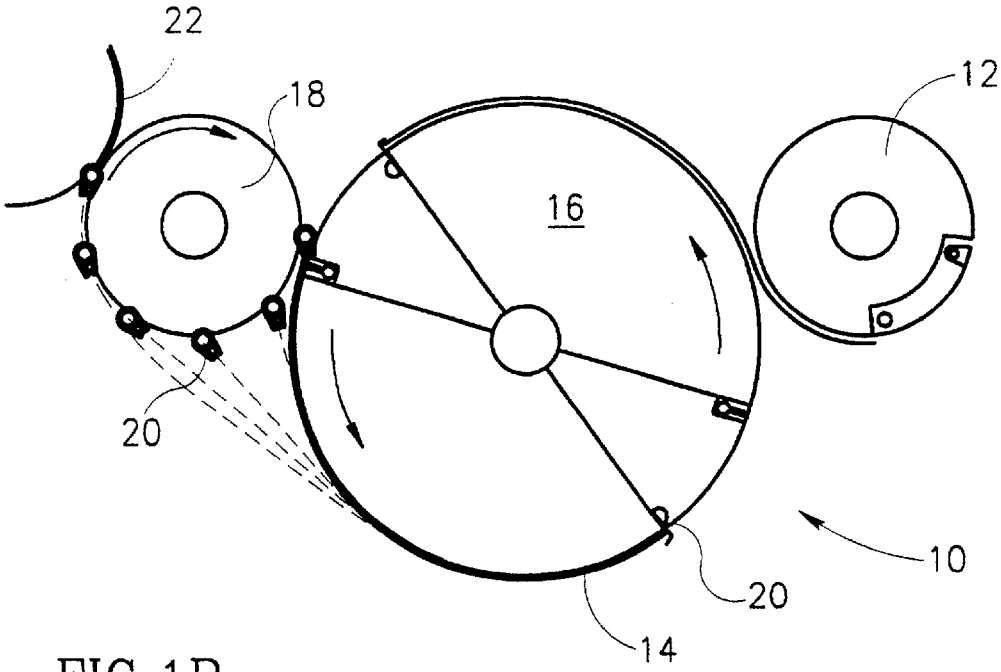
FIG. 1B PRIOR ART
Figure 2:
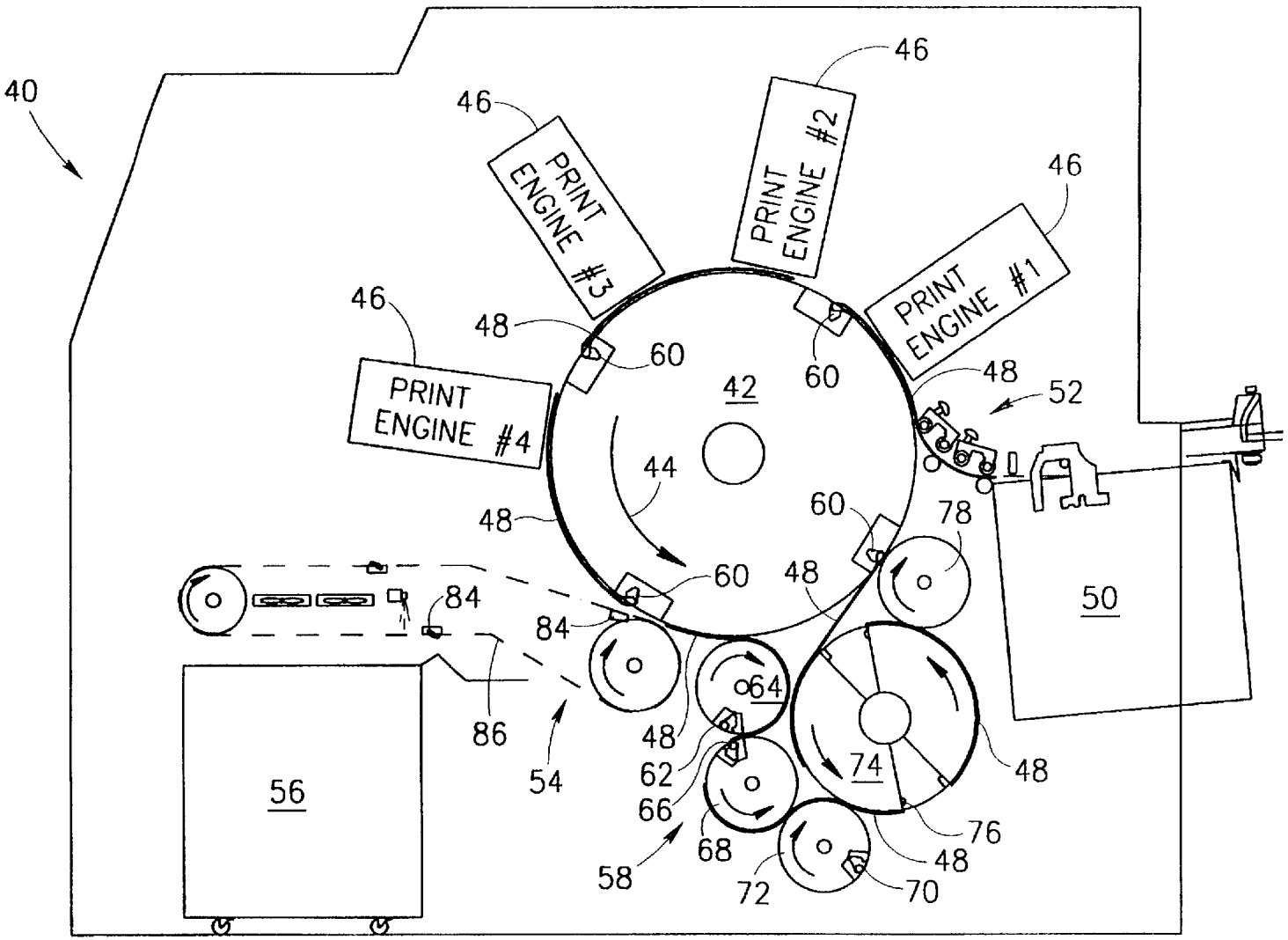
FIG. 2 is a schematic cross-sectional view of a single impression roller duplex printing apparatus in accordance with a preferred embodiment of the invention.
Figure 3:
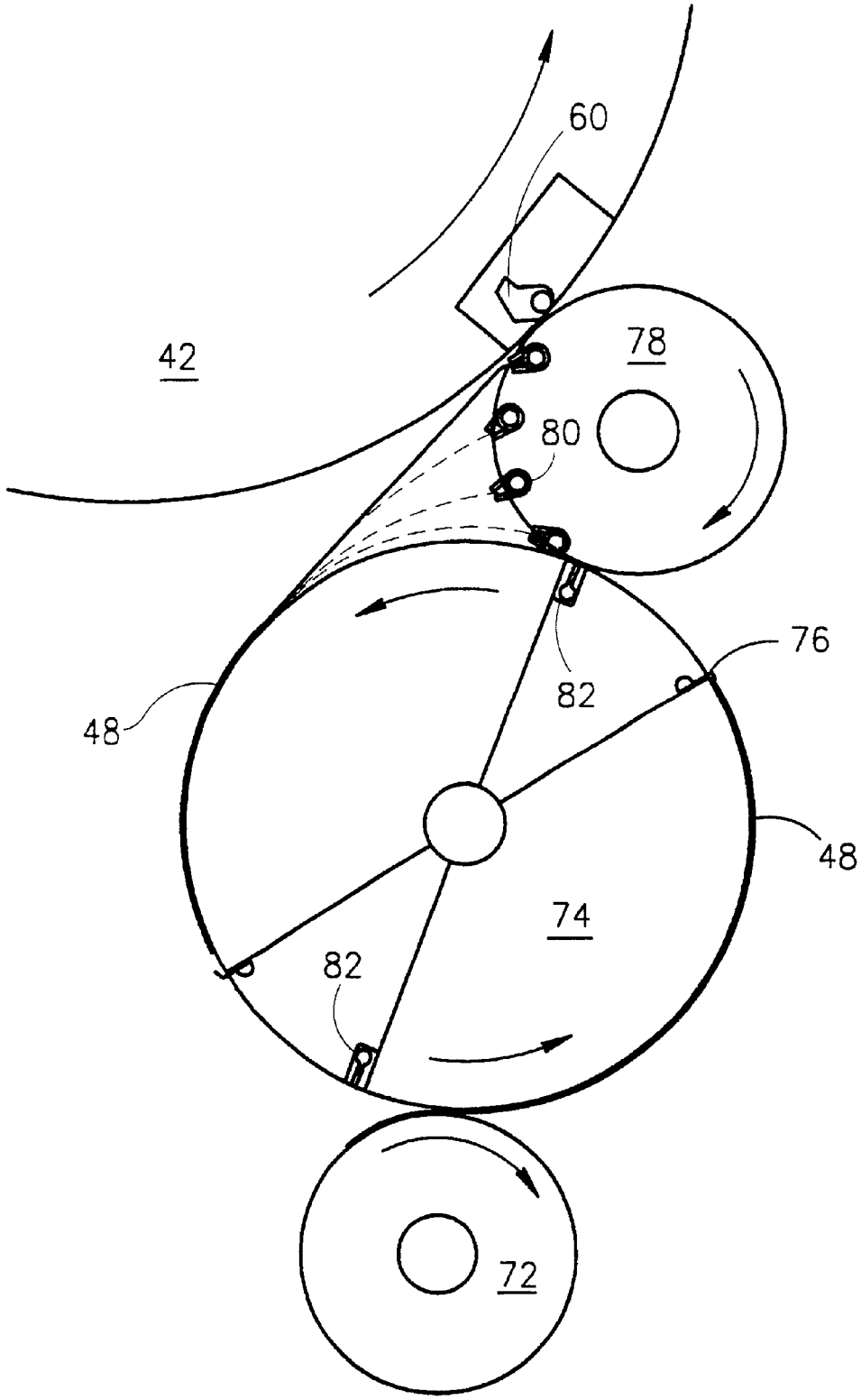
FIG. 3 is a schematic cross sectional view of a portion of the apparatus of FIG. 2, showing a portion the mechanism by which a sheet is inverted.

Reference is now made to FIGS. 2 and 3, which illustrate a multi-color duplex printing system 40 in accordance with a preferred embodiment of the present invention.

System 40 includes an impression roller 42 that rotates in a direction indicated by arrow 44. Situated around the periphery of roller 42 are one or more print engines 46. In a preferred embodiment of the invention, each of engines 46 transfers a single color image to substrate sheets 48 that are held on- and travel with-impression roller 42. Thus, as illustrated in FIG. 2, four color separations may be printed on a sheet as it sequentially passes the four engines shown. If it is desired to print a greater or lesser number of colors, more or fewer engines may be provided. While in a preferred embodiment of the invention engines 46 are a particular type of electrophotographic engine described below, any suitable electrophotographic engine or a printing engine of another type may be used. Especially suitable for use in the present invention are printing engines which print a variable image, such as a computer generated image. This allows for different images to be printed on the front and back of the sheet and for different images to be printed on sequential sheets.

Also situated around the periphery of impression roller 42 are a source of sheets 50 and associated sheet feeding apparatus 52, a sheet take-off apparatus 54, a stacker for printed sheets 56 and a sheet inverting system 58. A portion of inverting system 58, illustrating various stages in the inversion of a sheet, is shown in FIG. 3.

The following discussion describes the progress of a single sheet 48 as it is printed on both sides. As shown in FIG. 2, one edge of each of sheets 48 is held by a clamp 60 of conventional design. A sheet 48 is synchronously fed from source 50, by feeding apparatus 52 such that its leading edge is captured by one of clamps 60. Impression roller 42, which is preferably driven by a motor (not shown) carries sheet 48 past print engines 46 such that by the time it passes the last engine, printing of a first side of the sheet is complete. Alternatively, fewer engines may be used and each engine may print a plurality of colors in one of several rotations of impression roller 42. The sheet then approaches sheet take-off mechanism 54. Since only the first side of sheet 48 has been printed, mechanism 54 is not activated and sheet 48 passes it. A controller (not shown), which controls the printing and sheet transportation determines which path the sheet should take. As the leading edge of the sheet held by clamp 60 passes a first roller 64 of inverting system 58, the leading edge of sheet 48 is handed off to a similar clamp 62 on roller 64. The leading edge of the sheet is then successively handed off to a clamp 66 on a roller 68 and a clamp 70 on a roller 72. During each hand-off the sheet is held between two rollers and or by a clamp such that registration of the leading edge is preserved.

When the leading edge of the sheet approaches a roller 74, the leading edge is captured by a clamp 76 and carried toward roller 74. Roller 74 receives the sheet and a clamp 76 holds the sheet on the roller.

When the leading edge of sheet 48 reaches an inverting roller 78, the trailing edge is fed to a clamp 80 on roller 78 (shown more clearly in FIG. 3.) preferably utilizing by a lifter 82. Lifter 82 may lift the trailing edge of the sheet by air pressure or mechanically. Lifter 82 can also utilize a vacuum to hold the sheet to the roller. It should be understood that when clamp 80 captures the trailing edge of sheet 48, the position of the sheet is still determined by its leading edge, held by clamp 76. Clamp 76 releases sheet 48 as or just after it is captured by clamp 80.

However, while sheet 48 has reversed direction (as well as having been turned over), and is traveling with the (former) trailing edge first, its position remains referenced to the leading edge, which reference has been preserved during the various hand-offs of the sheet from roller to roller.

FIG. 3 shows a number of stages of transfer of sheet 48 from roller 74 to impression roller 42 by roller 78 and clamp 80. As can be seen from FIG. 3, the sheet has now been reversed and, when it is transferred to impression roller 42 it is ready for having its second side printed.

Returning again to FIG. 2, sheet 48 again passes printing engines 46 whereat an image is printed on the second side of the sheet.

The sheet now approaches take-off apparatus 54. Since both sides of the sheet have now been printed, the sheet is ready for removal. As clamp 60 (holding the edge of the sheet) approaches apparatus 54, a clamp 84 on a belt 86 receives the sheet and removes it to stacker 56.

When the blank space in the inverter system reaches the impression roller another sheet is fed to impression roller 42 from source 50 and placed in the position vacated by the sheet which was removed by apparatus 54. It should be understood that whenever no sheet is available from inverter 58 to fill a clamp 60, a new sheet is preferably fed from paper source 50.

While the system has been shown with an inverter having a path that holds three sheets at one time and an impression roller that has four sections for holding sheets, a greater or lesser number of sheets and positions can be provided. One major consideration is the amount of room taken by the print engines and other apparatus situated around the periphery of the impression roller. Furthermore, while separate engines for each color are shown, a single multicolor engine may be provided. Furthermore, stacker 56 may be replaced by a finisher which produces booklets directly from the sheets as they are printed.

Figure 4:
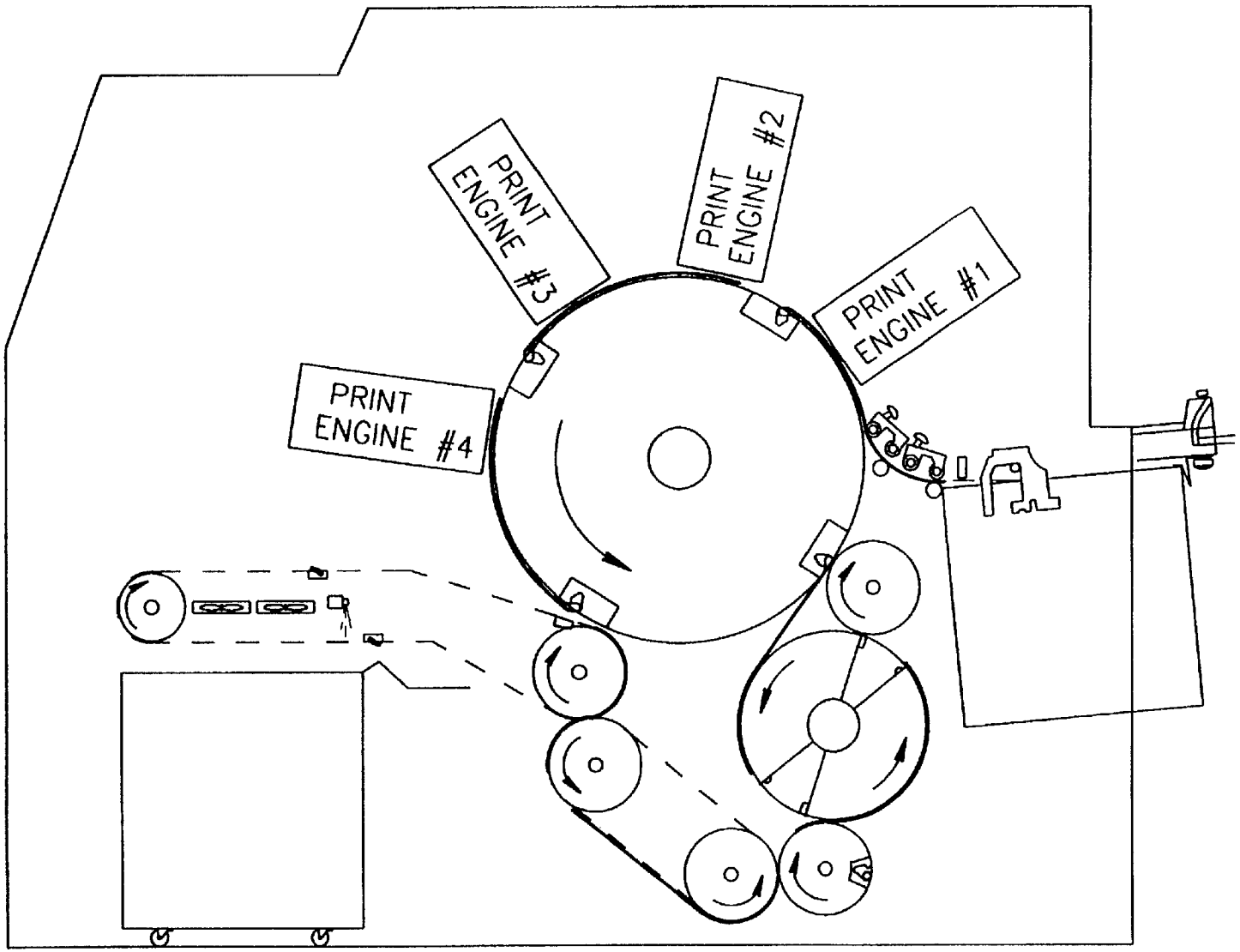
FIG. 4 is a schematic cross sectional view of an alternative apparatus for inverting a sheet in accordance with a preferred embodiment of the invention.

FIG. 4 shows an alternate inverting system in which rollers 64 and 68 have been replaced by a belt mechanism which receives the sheets from the front end of take-off apparatus 54.

Figure 5:
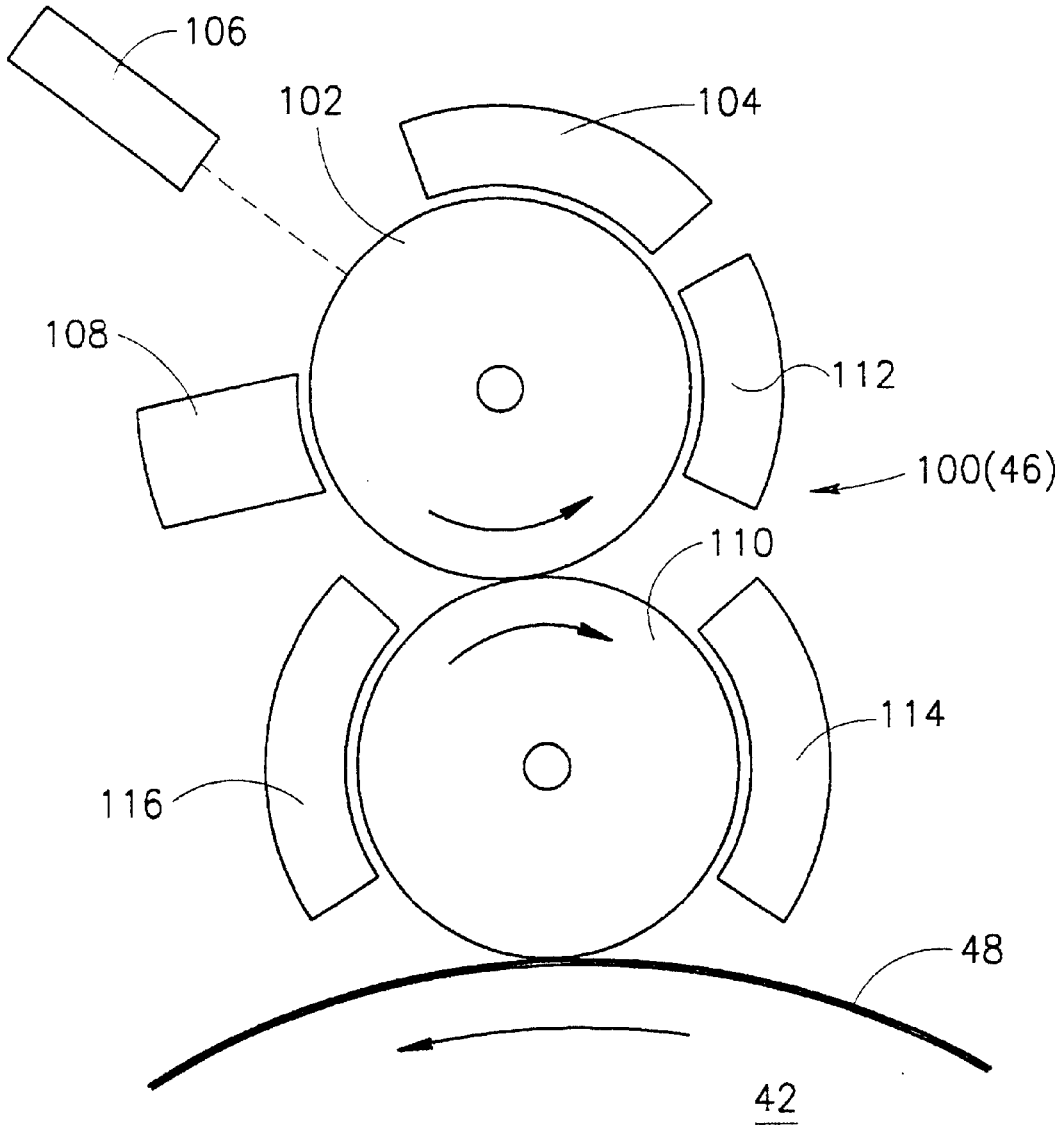
FIG. 5 is a very schematic cross-sectional illustration of a printing engine in accordance with a preferred embodiment of the invention.

FIG. 5 shows a very schematic representation of a preferred printing engine 100 (corresponding to one of engines 46 of FIG. 2), in accordance with a preferred embodiment of the invention. While preferred engine 100 is especially suitable for a high speed duplexing system as shown in FIGS. 2–4, as indicated above, the duplexing system can operate with a wide variety of print engines. Similarly, engine 100 may operate with other types of duplexing systems or in a single sided printer.

Engine 100 includes a photoreceptor drum 102, a charger 104 which charges the photoreceptor, an imagewise discharge system, such as a scanning laser 106 which forms a latent image on charged drum 102 and a developer 108 which develops the latent image. The developed image is preferably transferred to an intermediate transfer member 110. After the image is transferred to intermediate transfer member 110, photoreceptor 102 is cleaned of residual toner by a cleaning station 112.

For slow speed systems, intermediate transfer members as described below can operate without any drying systems. In these systems the heat of the intermediate transfer member dries the image somewhat and removes some of the liquid carrier in the image, to improve the transfer of the image to sheet 48 on impression roller 42. For some systems, liquid is removed prior to transfer of the image to the intermediate transfer member. For high speed imaging a dryer 114 is preferably used to dry the image on the intermediate transfer member. After transfer of the image to sheet 48, a further dryer 116 removes some liquid which remains on or is solvated by the intermediate transfer member to improve transfer of the next image to the intermediate transfer member.

The duplexing mechanisms shown in FIGS. 2–4 operate in a synchronous manner with all of the rollers and/or belts moving in a synchronous manner. Thus, these duplex mechanisms are basically limited to one size sheet of paper or other printing material.

Figure 6:
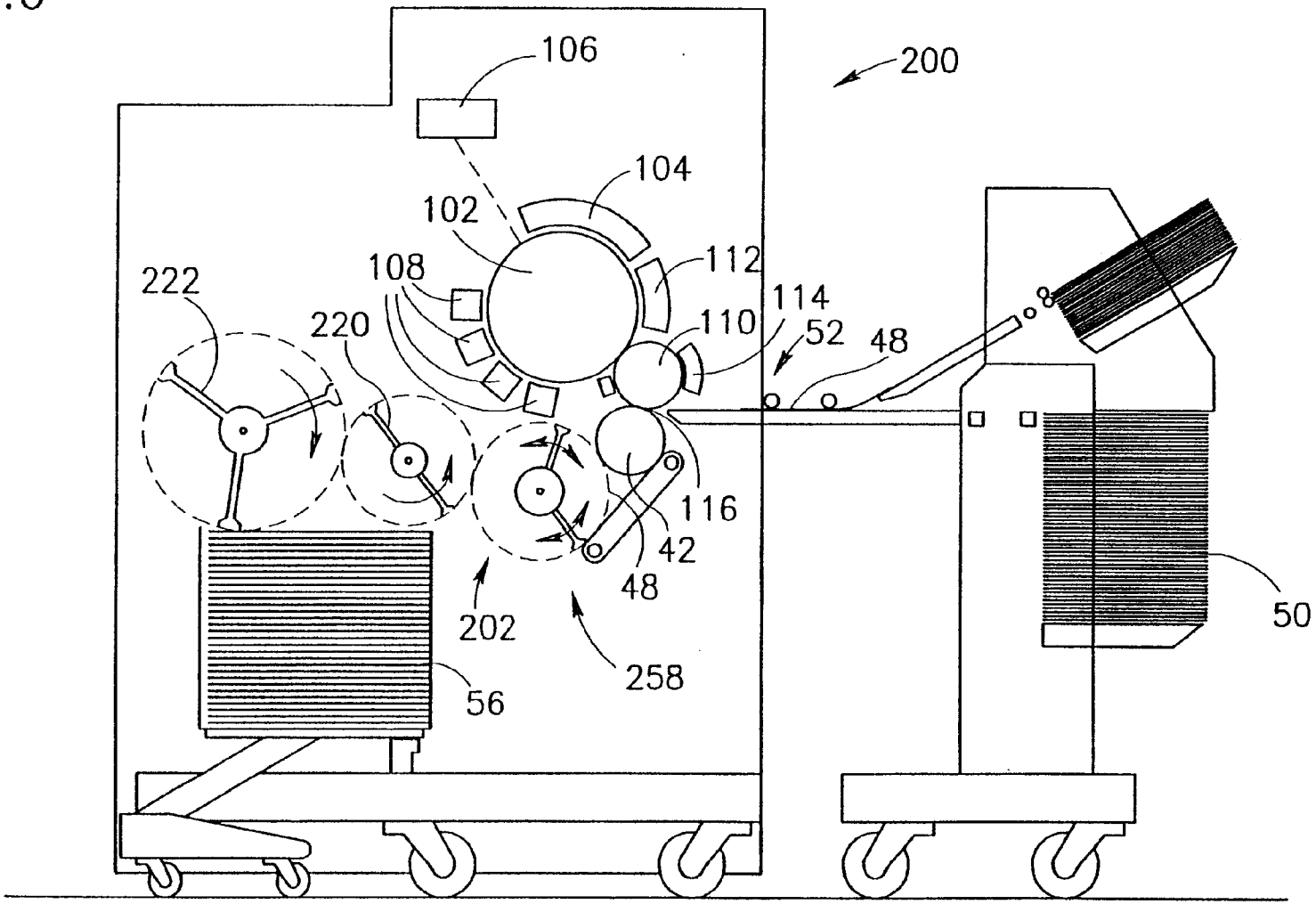
FIG. 6 is a schematic cross-sectional view of a second single impression roller duplex printing apparatus in accordance with a preferred embodiment of the invention.
Figure 7:
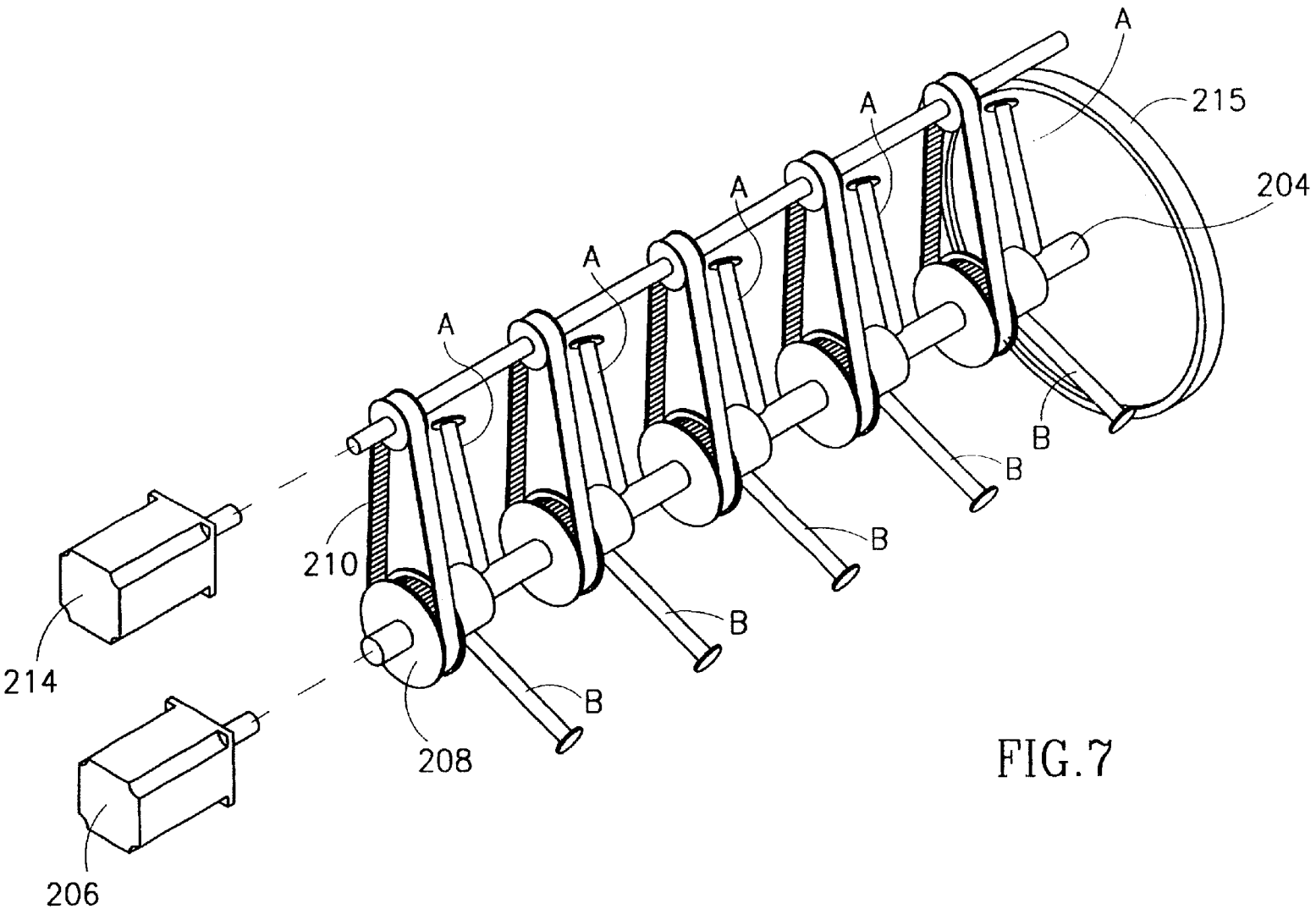
FIG. 7 is a schematic isometric view of a portion of a sheet inverter of the preferred embodiment of FIG. 6.

FIGS. 6–8 illustrate a printer having a duplexing mechanism which can handle a large variety of sheet sizes.

FIG. 6 shows a general layout of a printer 200 in accordance with a preferred embodiment of the invention. In addition to the differences in the duplex mechanism described below, printer 200 differs from printer 40 in other ways. For example, in printer 40 a plurality of printing engines 46 (shown as engine 100 in FIG. 5), each including a photoreceptor 102 and associated components and an intermediate transfer member 110 and associated components. Printer 200 of FIGS. 6–8, utilizes a single photoreceptor 102 and intermediate transfer member 110. However, situated about photoreceptor 102 are a plurality of developers 108. Each developer develops an electrostatic image on photoreceptor 102 with a different color image. In a preferred embodiment of the invention, a sheet 48 on impression roller 110 rotates once for each color and the different color images are transferred to the sheet seriatim. Preferably, photoreceptor 102 is large enough so that a plurality or all of the individual color images are developed during a single rotation of photoreceptor 102.

It should be understood that the printing arrangement shown in FIG. 6 and that shown in FIGS. 2–5 are substantially interchangeable and can be used with any of the sheet inverting apparatus shown in this application or with sheet inverting apparatus of the prior art. As indicated above, the sheet inverting apparatus disclosed herein can be used with any suitable printer system known in the art.

Printer 200 shows sheet inverting apparatus 258 which is different from sheet inverting apparatus 58 of FIGS. 2–4. In particular, inverting apparatus 258 is capable of handling sheets of different sizes. It can invert sheets all of which are the same size and also invert sheets which have different sizes and which are interleaved.

In a preferred embodiment of the invention, when a sheet 48 is fed by feeding apparatus 52, a detector detects the leading and trailing edges of the sheet being fed. The length of the sheet thus determined is transferred to a controller (not shown) which also controls the movement of the other elements of the printer as described below.

After being fed, sheet 48 is acquired by clamp 60 on impression roller 42. Impression roller 42 may carry a single sheet or multiple sheets (a single sheet version is shown in FIGS. 6–8) at one time. After capture, individual color images are generated on photoreceptor 102 and transferred to the sheet, seriatim. In general, the photoreceptor may have a diameter many times that of the impression roller, such that the images can all be developed on the photoreceptor. during a single rotation of photoreceptor 102, which corresponds to multiple rotations of impression roller 42. Of course, the images on photoreceptor 102 are spaced such that, when transferred to sheet 48, they are overlaid in an aligned manner.

When all the color images have been transferred to sheet, it is acquired by a first transfer mechanism 202. Mechanism 202 is shown in perspective in FIG. 7 and a portion of inverting mechanism 258 is shown in FIG. 8. As shown in FIG. 7, mechanism 202 preferably comprises two sets of vacuum pick-up arms A and B. Arms A are attached to and rotate with a central shaft 204, driven by a motor 206. Arms B are attached to and rotate with a series of elements 208 which can rotate about shaft 204. Arms B are made to rotate together by a series of belts 210 and a shaft 212 which is driven by a motor 214. As is clear, arms A rotate together and arms B rotate together as sets; however, the set of arms A and the set of arms B can rotate independently of each other.

Also shown in FIG. 7 is a disk 215 preferably mounted on shaft 204. The radial extent of disk 215 is substantially the same as that of arms A and B. In a preferred embodiment of the invention, a plurality of such disks are present, where the disks are placed between the arms A, preferably one between each pair of arms. Only one is shown for clarity of presentation.

Figure 8A:
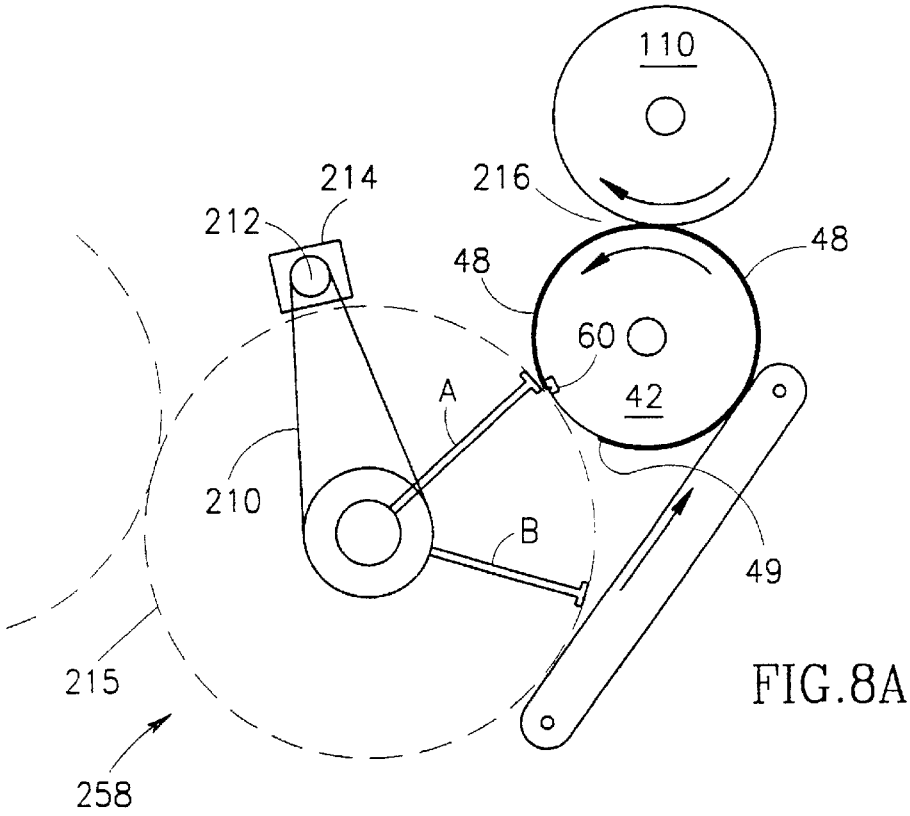

FIG. 8A shows mechanism 258 at a moment when gripper 60 which grips the leading edge of sheet 48 has just reached a point at which arms A can grip the sheet. (The trailing edge of the sheet is shown by reference number 49). Arm B is also shown, however, it does not yet play any part in the operation. At this point gripper 60 release sheet 48 arms A which are suction arms acquire the sheet. It should be understood that at this point sheet 48 is still held in a nip 216 between intermediate transfer member 110 and impression roller 42. The tip of arms A rotate together with impression roller such that the sheet is removed from the impression roller gradually as portions of the sheet reach the 8 o'clock position on impression roller 42.

At a later period shown in FIG. 8C, trailing edge 49 of sheet 48 is free of nip 216, (shown in FIG. 8B). At this point sheet 48 is no longer held by impression roller 42 and is free to move under the influence of arms A. However, it remains on the impression roller due to its being held by arms A and by friction with impression roller 42 and disks 215. It should be noted that at this point a new sheet 48' is approaching gripper 60 which meanwhile has rotated to about 11 o'clock. Arm A then advances the sheet so that it "falls off the edge" of impression roller onto a belt 218. This position is shown in FIG. 8D. It is noted that the image printed on sheet 48 is facing away from the belt. It is noted that at this point gripper 60 has gripped new sheet 48', having a trailing edge 49', and carried it into nip 216.

Arms A hold sheet 48 in the position shown in FIG. 8D while the impression roller (together with sheet 48' rotates a number of times required to transfer color images to it from intermediate transfer member 110. At that time it is ready to be removed and replaced by sheet 48 so that the unprinted side of the sheet is printed.

Figure 8B:
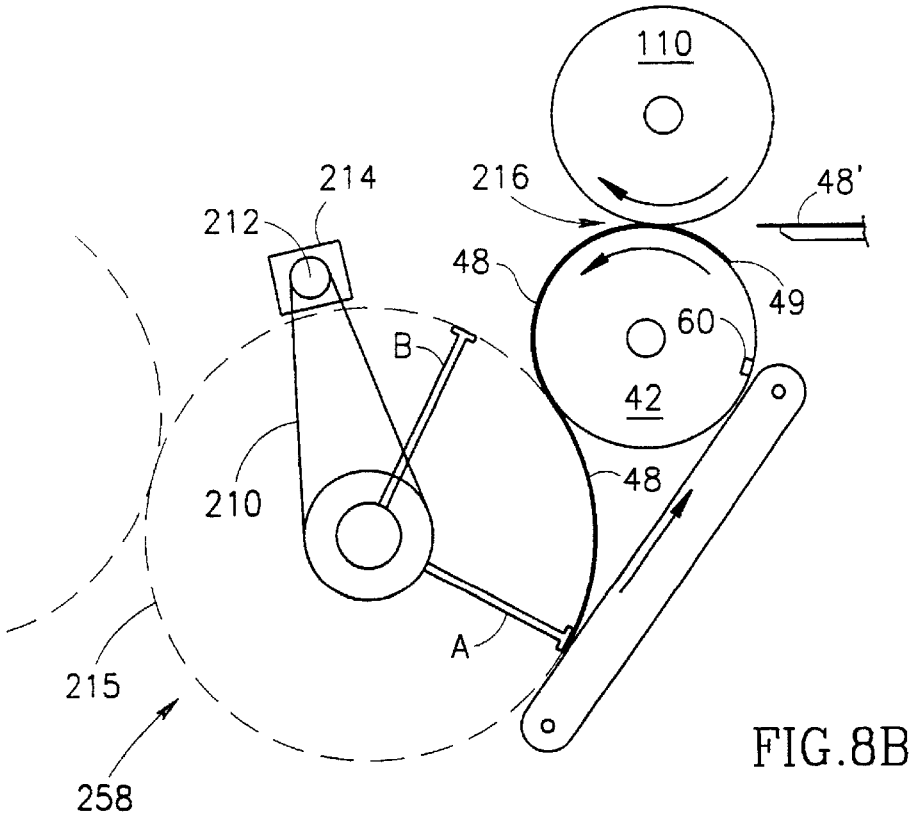
Figure 8C:
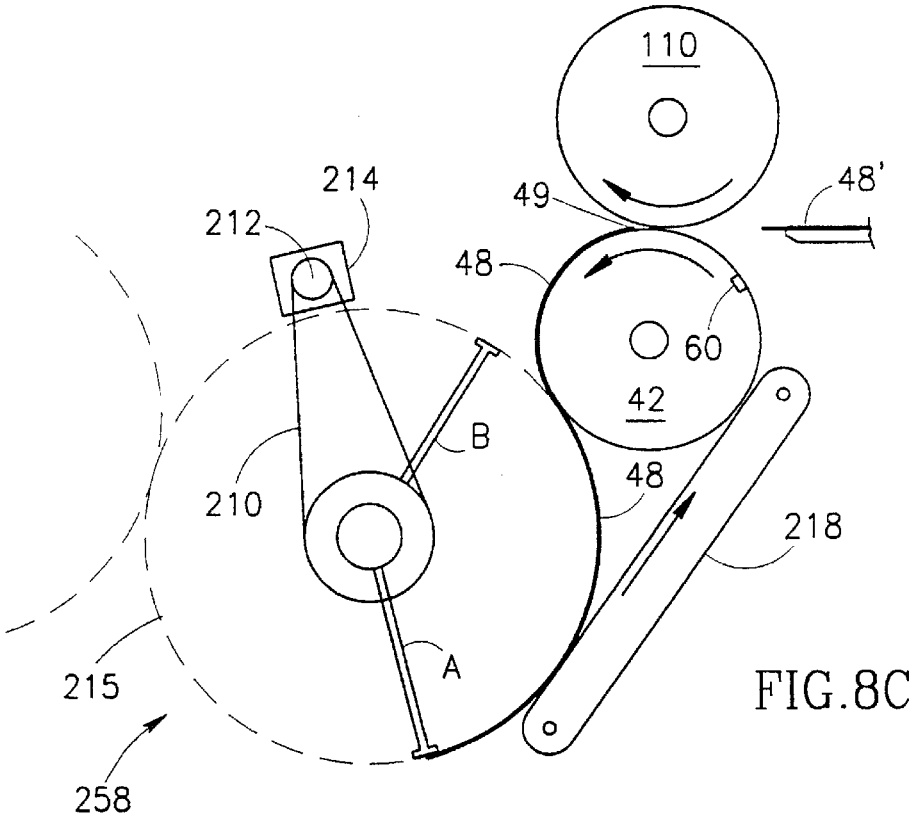
Figure 8D:
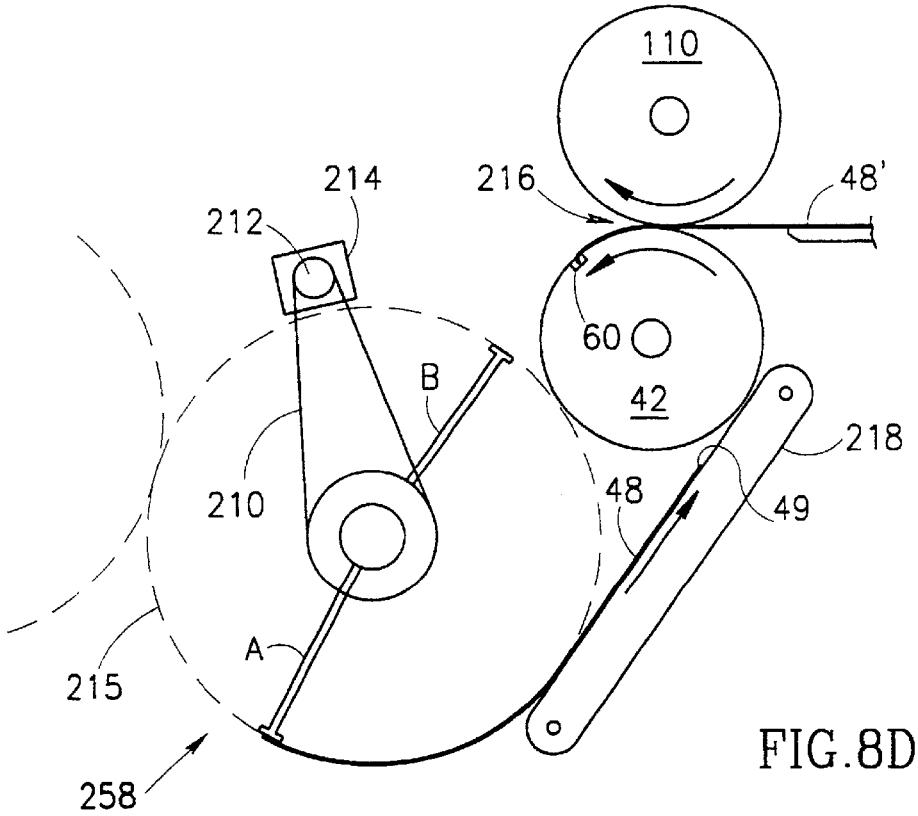
Figure 8E:
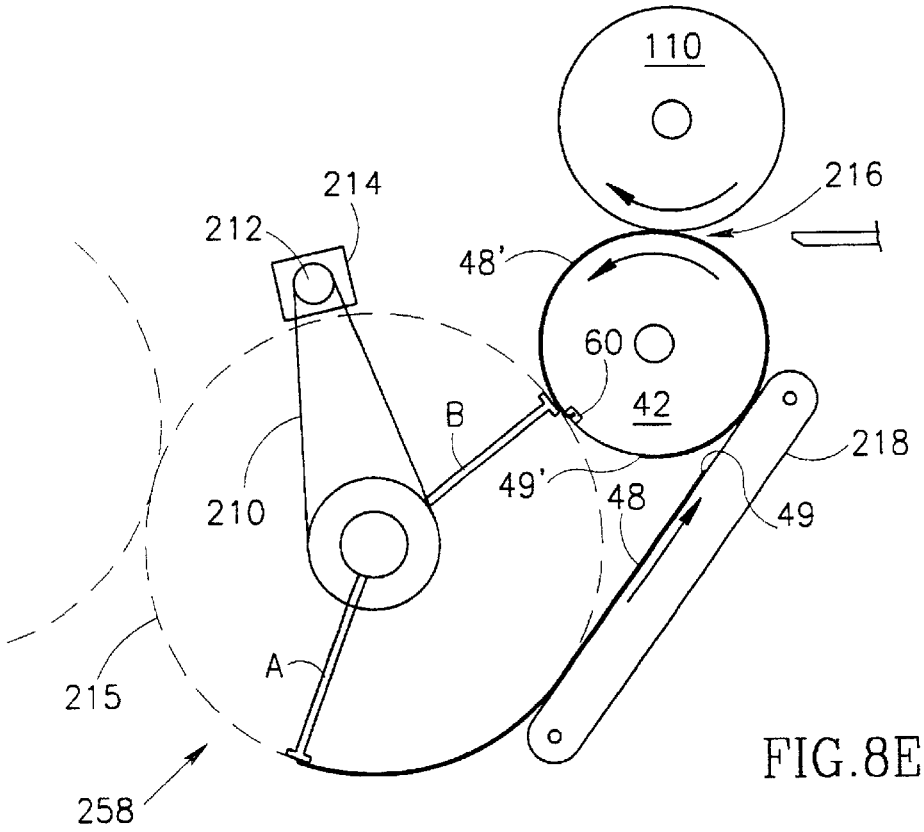
Figure 8F:
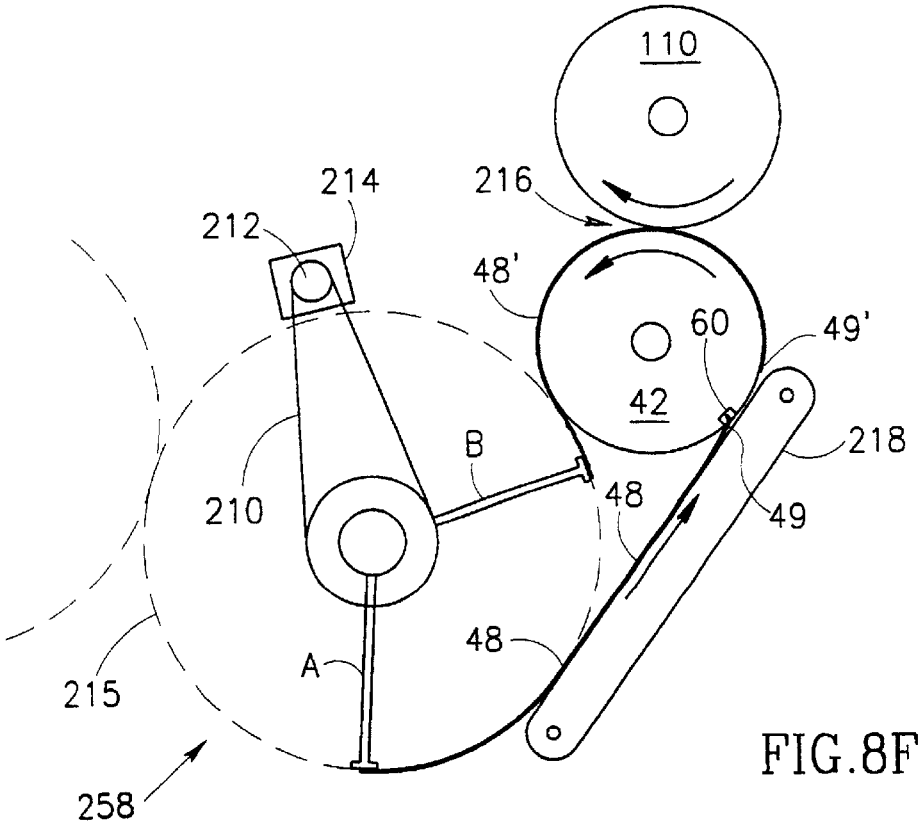

FIG. 8E shows this condition. Arms B have now gripped sheet 48' after its release by grippers 60. At this point arms A start rotating counterclockwise such that trailing edge 49 of sheet 48 reaches gripper 60 when it reaches belt 218 at which point it acquires sheet 48. This is shown in FIG. 8F. Arms A then release sheet 48, which is carried along by impression roller 42 for printing of the reverse side of sheet 48. It should be noted that while gripper 60 has gripped the trailing edge of the sheet, it remains referenced to its leading edge, since this edge (or at least the sheet referenced to this edge) are held throughout by arms A and/or belt 218.

In a continuation of the operation, the situation shown in FIG. 8B is reached with A replacing B and with trailing edge being held by gripper 60 and the leading edge lying on belt 218.

In alternate preferred embodiments of the invention, belt 218 is provided with vacuum grippers or other mechanical grippers which acquire the sheet such that it is carried towards gripper 60 by the belt and not by the arms. In this situation, it is possible to provide only a single set of arms.

Alternatively or additionally the impression roller is enlarged somewhat so that the length of sheet 48 is only about 70% or less than the circumference of impression roller 42. Under these conditions, the single set of arms will have enough time to drop one sheet and move to the position at which it has to pick-up the sheet.

Alternatively or additionally, the impression roller is enlarged such that it holds two sheets at the same time. For this configuration, only a single arm is necessary, especially if belt 218 is supplied with grippers.

After the reverse of sheet 48 is printed, the reverse of sheet 48' is to be printed. The attachment of sheet 48' to impression roller 42 is as described above for sheet 48. Sheet 48 is now removed from the printer according to the process whose start is shown in FIGS. 8G and 8H. In FIG. 8G sheet 48' is advancing toward nip 216 and sheet 48 has been gripped by arms A. In general, the position of grippers 60 and the arms is similar to that shown in FIG. 8D, except that arm A does not stop at this point but continues carrying sheet 48 to the position shown in FIG. 8H.

As shown in FIG. 8H, in a preferred embodiment for the invention, sheet 48 is advanced so that it meets gripper arms 220, which may be of the same type as arms A and B. Gripper arms 220 transfer the sheet directly to exit stack 56. See FIG. 6. Alternatively, if it is desired to invert the sheet before stacking, an addition set of gripper arms 222 receives the sheet from arms 220 and delivers it to the stack. Alternatively, a belt may receive the sheet from arms A and transfer it to the stack. Alternatively or additionally, stacker 56 may be replaced by a finisher which produces booklets directly from the sheets as they are printed.

Figure 9:
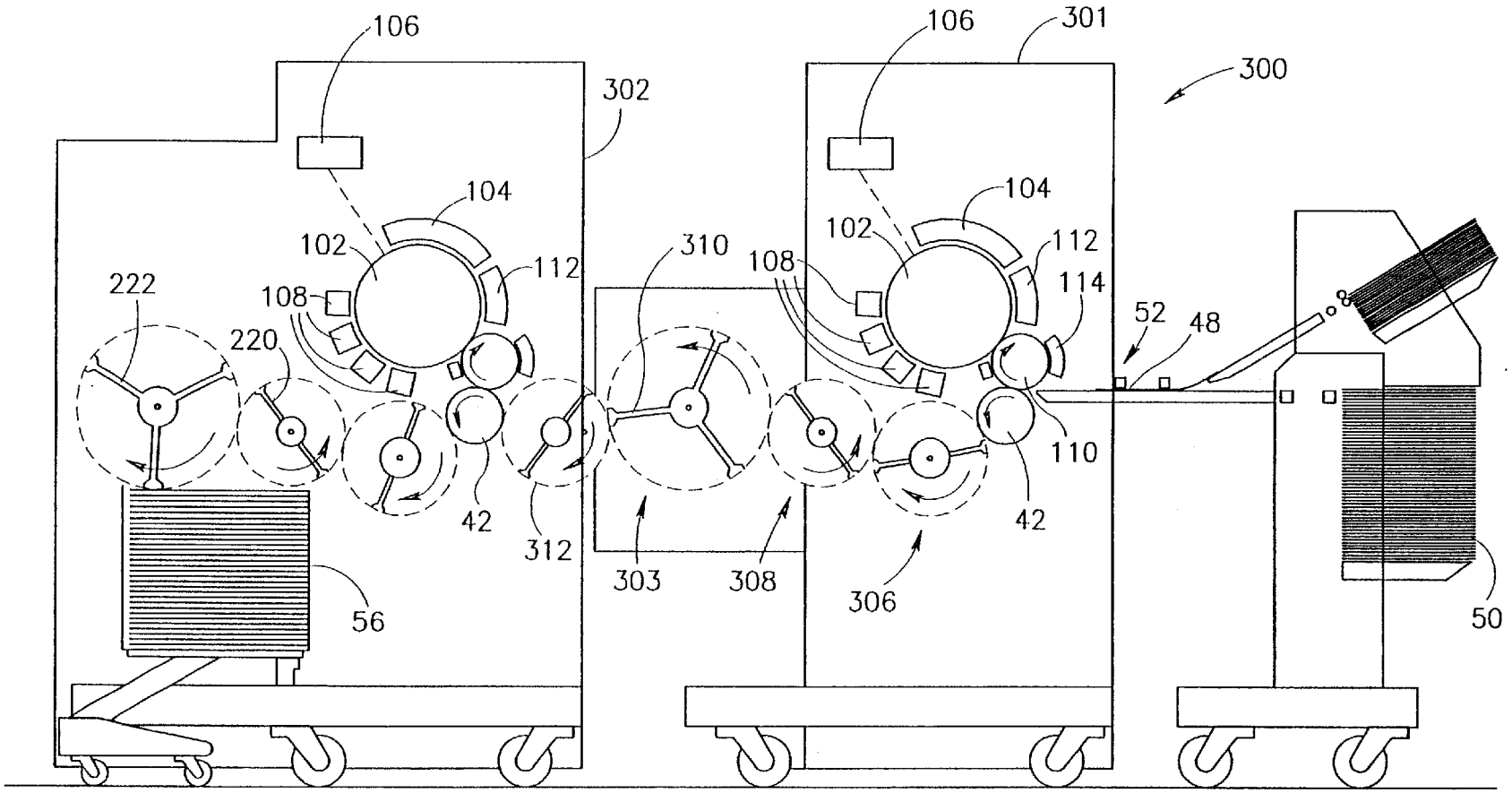
FIG. 9 is a schematic cross sectional view of a dual duplex printer in accordance with a preferred embodiment of the invention.

FIG. 9 shows a tandem printer 300 for duplex printing. Printer 300 is comprised of first printer section 301, second printer section 302 and transfer section 303. After one side of a sheet is printed in first printer section 301 the sheet is removed from impression roller 42 by a vacuum gripper arm 306. Gripper arm 306 transfers the sheet to a second gripper arm 308. The sheet is then transferred to gripper arms 310, which in turn transfer the sheet to gripper arms 312. The sheet is then transferred to an impression roller 42. It should be noted that the sheet is image side down on arms 306, image side up on arms 308, image side down on arms 310 (note the reversal of direction of the sheet), image side up on arms 312. The sheet is placed image side down on the second impression roller such that the inverse side of the sheet is printed in the second printer.

In each of the above embodiments, grippers 60 are shown as mechanical grippers. However, in alternative preferred embodiments of the invention, air suction grippers may be used on impression roller 42.

The elements of engine 100 or the printer section of FIGS. 2–9 may be purely conventional as has been described in numerous patents, patent applications and patent publications assigned to the assignee of the present application, Indigo, Nev. and Spectrum Sciences B.V. In addition certain parts of the preferred embodiment of the invention including intermediate transfer blankets, photoreceptor sheets, etc. are available from Indigo, Nev.

Some of such elements are described, for example. in PCT publications WO 94/23347, WO 96/17277, WO 97/07433, in U.S. Pat. No. 4,684,238, PCT Publication WO 90/04216, U.S. Pat. No. 4,974,027 and WO 93/01531 and in other patents and applications referred to therein. The disclosures of all these documents are incorporated herein by reference.

Figure 10:
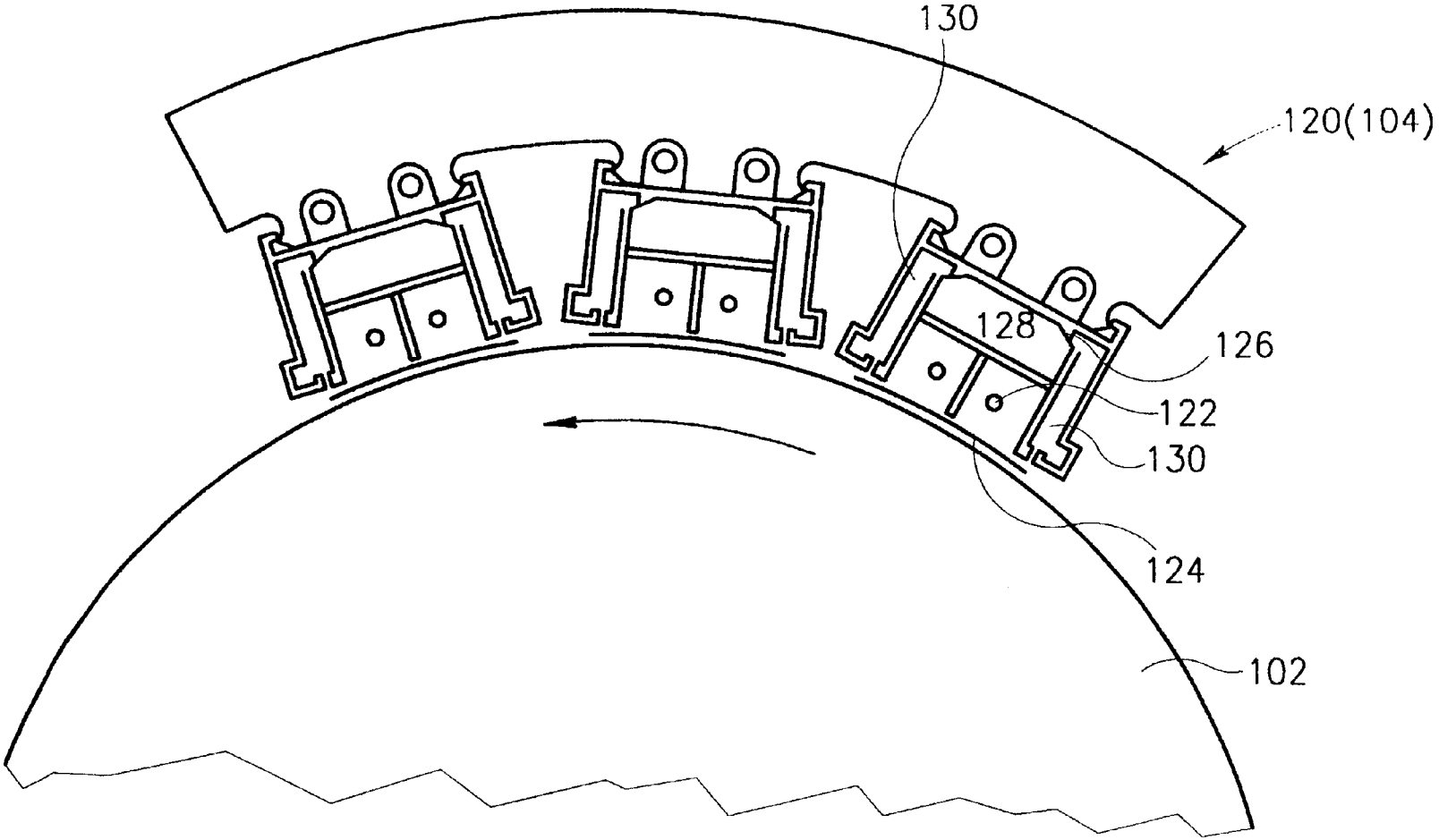
FIG. 10 illustrates a photoreceptor charging system, especially suitable for high speed printing, in accordance with a preferred embodiment of the invention.

FIG. 10 shows a preferred embodiment of a charger 120 corresponding to charger 104 of FIGS. 5 and 6. The charger shown comprises six corotrons or scorotrons, each comprising a charging surface such as a charged wire 122 and grid 124 for scorotrons, although a greater or lesser number may be used as required. Each pair of scorotrons is preferably housed in a housing 126 including a chamber 128 into which air is pumped. This air is forced by pressure past wires 122 and onto the surface of photoreceptor 120. This flow of air carries away evaporated carrier liquid which otherwise has a tendency to coat the wires and reduce their life. In addition, this flow also caries away ozone which is generated by the charging surface.

In order to prevent the air (now containing some carrier liquid and/or ozone) from contaminating the surroundings, both inside the printer and outside of it, chambers 130 are provided, beside the scorotrons. These chambers are connected to suction pumps, such that air fed to chambers 128 and passing wires 122 to the surface of drum 102 is immediately removed from the environment. In a preferred embodiment of the invention, carrier liquid and/or ozone are removed from the air suctioned via chambers 130, for example by catalytic action.

Figure 11:
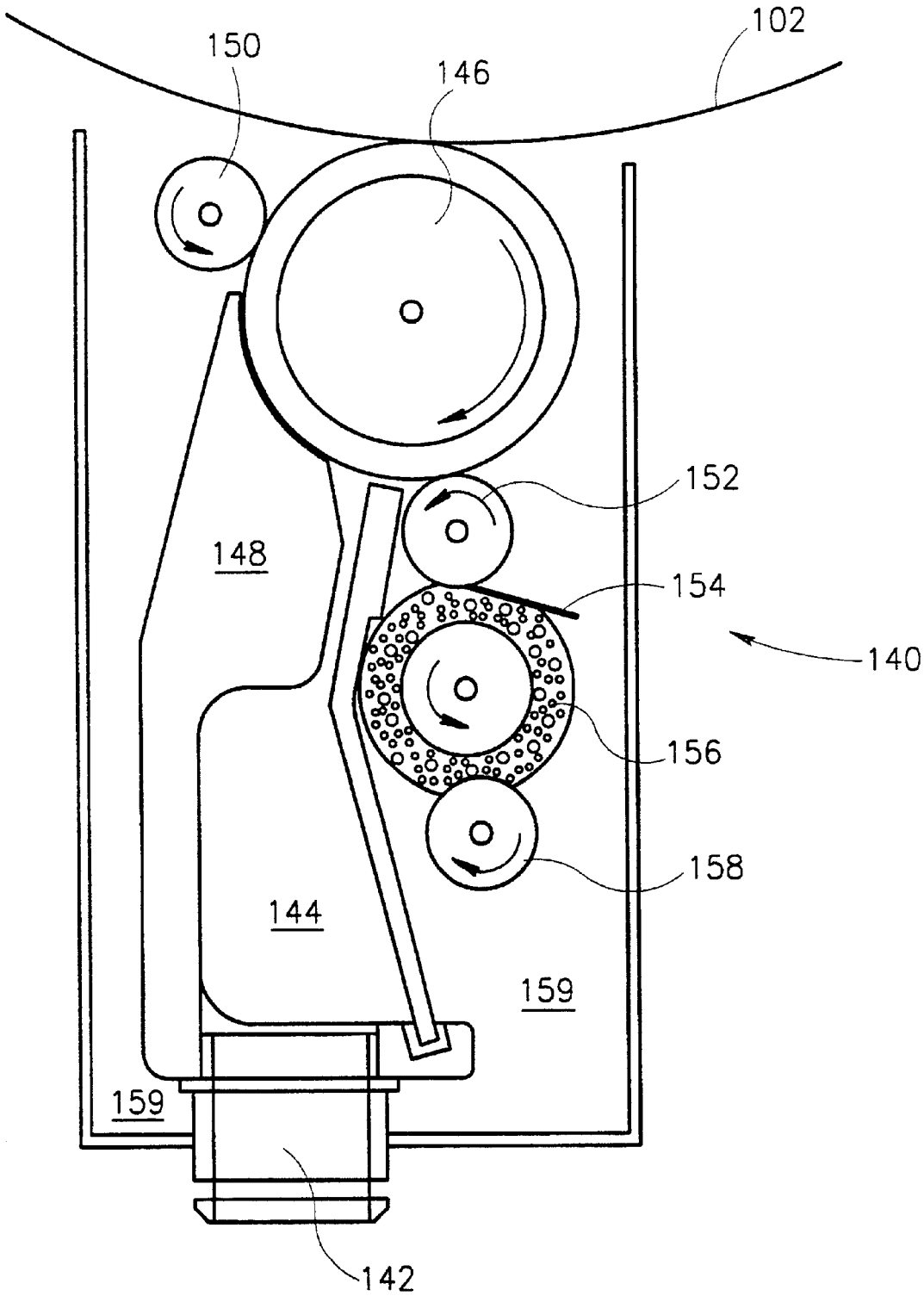
FIG. 11 illustrates a developing station in accordance with a preferred embodiment of the invention.

FIG. 11 shows a preferred embodiment of a developer 140 corresponding to developer 108 of FIGS. 5 and 6. This developer corresponds generally to developers whose structure and operation is shown and described in WO 93/01531 and WO 95/10801, the disclosures of which are incorporated herein by reference. Developer 108 comprises a toner inlet 142 which feeds toner concentrate to a toner chamber 144. Toner is fed from chamber 144 to a rotating developer roller 146. The rotation of developer roller 146 pumps the toner past an electrode 148. A voltage difference between electrode 148 and roller 146 preferably coats roller 146 with a concentrated layer of toner. A squeegee 150 preferably removes additional liquid from the toner layer which layer is then selectively transferred to develop a latent image on photoreceptor 102. Toner remaining on developer 146 is preferably removed by a charged roller 152 (see for example element 174 in FIG. 7B of WO 93/01531). Toner is preferably removed from roller 152 by the combined action of a scrapper 154 and a counter rotating sponge roller 156. A squeegee 158 preferably compresses sponge roller 156 and removes excess material from it into a waste chamber 159. Other designs of liquid development systems or powder toner systems may be substituted for developer 140 if desired.

Figure 12:
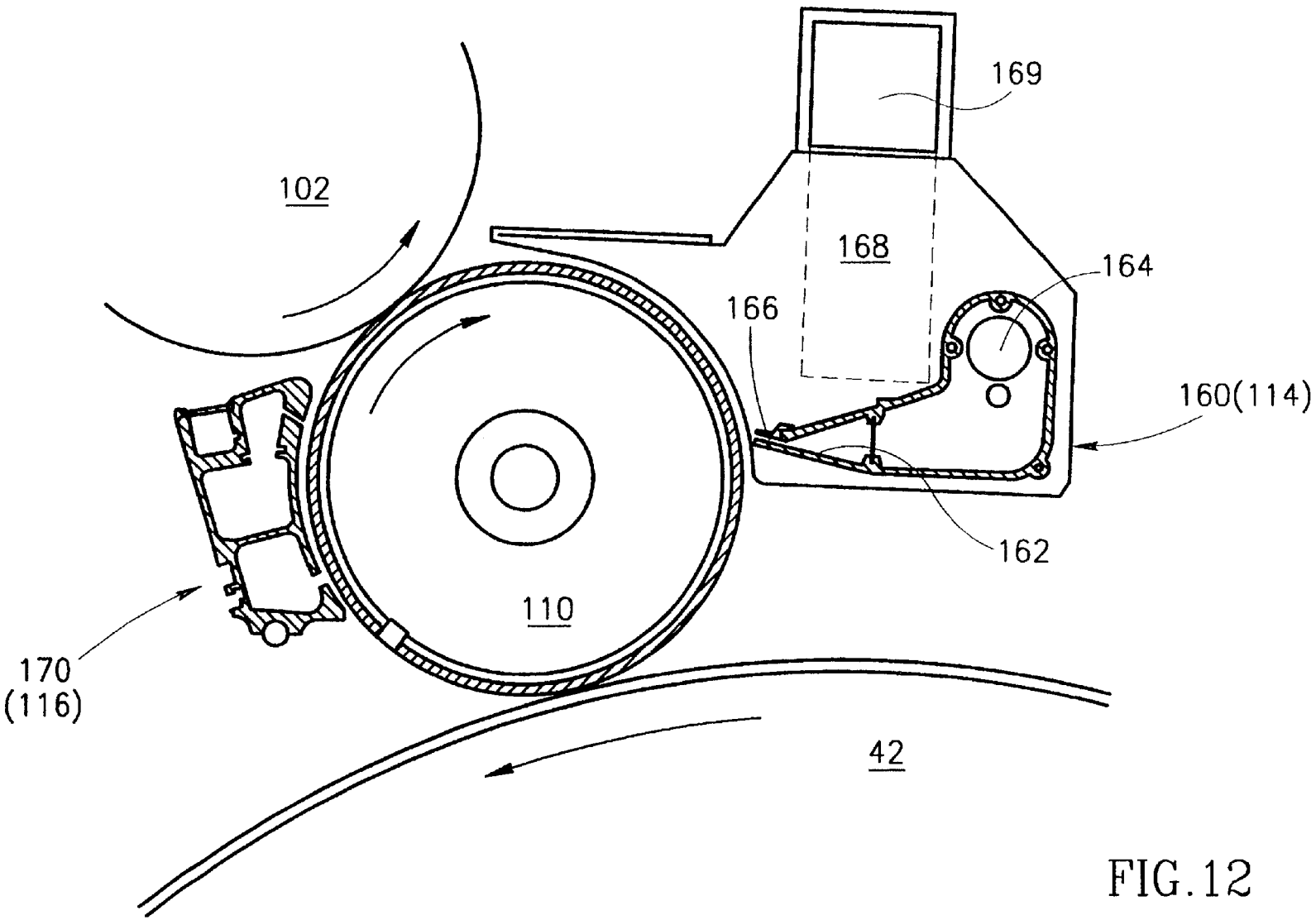
FIG. 12 illustrates an intermediate transfer member and associated apparatus, in accordance with a preferred embodiment of the invention.

FIG. 12 shows further details of print engine 100 and printer 200. In preferred embodiments of the invention, especially where the printing speed is high, it is desirable to dry the image somewhat while heating it on intermediate transfer member 110. To this end, a dryer 160 (corresponding to dryer 114 of FIG. 5 or 6) is preferably provided. To minimize the amount of pollution generated, dryer 160 preferably comprises a chamber 162 into which air is pumped via an inlet 164. The air exits chamber 162 via an exit slit 166 onto the surface of transfer member 110. The air which exits slit 166 preferably forms an air knife. A second chamber 168, open to the surface of the transfer member, is provided with an exit for air through which air is withdrawn via an exit port 169. Thus, excess carrier liquid that is withdrawn from the image on intermediate transfer member 110 is immediately removed without polluting the internal environment of the printer.

To improve transfer of images and to provide more consistent transfer, intermediate transfer member 110 is preferably provided with a further dryer 170 (corresponding to dryer 116 of FIG. 5 or FIG. 6), which dryer operates in a similar manner to dryer 160, in that air is forced onto the surface of the intermediate transfer member and is removed therefrom by suction.

In preferred embodiments of the invention, carrier liquid removed by dryers 160 and 170 is removed from the air stream, for example by catalytic action and the air is recirculated for drying.

Figure 13:
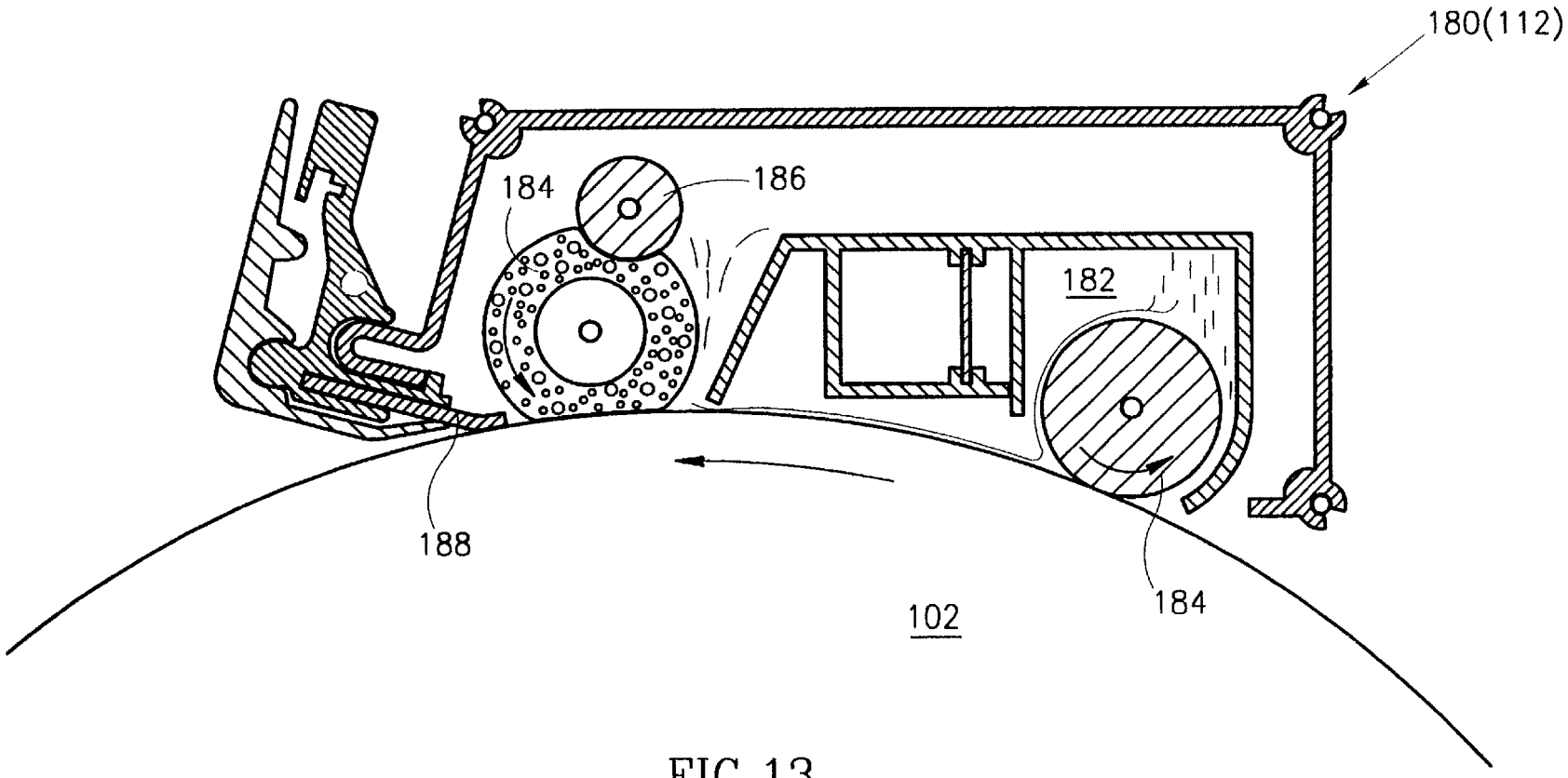
FIG. 13 is a cross-sectional representation of a cleaning station in accordance with a preferred embodiment of the invention.

FIG. 13 shows a cleaning station 180 corresponding to cleaning station 112 of FIG. 5. Cleaning station 180 comprises three stages. In a first stage cooled liquid (for example carrier liquid) is supplied to the surface via a chamber 182. A roller 184 is operative to keep the liquid from leaking out of the cleaner and for pumping it in the upstream direction of photoreceptor 102. The cooled liquid flows along the surface of the photoreceptor to a counter-rotating sponge roller 184 which removes adhering toner particles. These particles and liquid picked up by the sponge roller are squeegeed out of sponge roller 184 by a squeegee roller 186. A scrapper blade 188 completes the cleaning process by scrapping any remaining toner from the surface and keeping excess carrier liquid from leaving the cleaning station.

While preferred printing engines have been shown and described, it should be understood that duplex printers of the type described above may use other types of electrographic printers as are known in the art. Thus, the printing engines may be of any suitable type. Preferably, the engines are of a type which produces images under control of a computer such that the images may be changed from print to print. Such printers are generally known as "digital" printing engines. Furthermore, while in the preferred embodiment of the invention, image transfer utilizing an intermediate transfer member is described, such transfer may be replaced by direct transfer from an imaging surface.

While the present invention has been described with respect to preferred embodiments thereof, these embodiments are presented by way of example only and are not meant to limit the scope of the invention which is defined by the claims. Furthermore, embodiments of the invention may incorporate some but not all features of the above preferred embodiments and may include combinations of features from different embodiments. As used in the claims the terms "comprise" or "include" and their conjugations shall mean "including but not necessarily limited to."

What is claimed is:

1. Duplex printing apparatus for printing on two sides of a sheet the apparatus comprising:

an impression roller on which the sheet is held during printing;

an imager which prints an image on a first side of the sheet while it is being held on the impression roller; and a sheet inverter which removes the sheet from the impression roller, inverts the sheet and returns it to the impression roller for printing on a second side of the sheet by the imager, wherein the sheet is held on said impression roller referenced to a first edge thereof during the printing of the first side thereof and is also held on the impression roller referenced to said first edge during printing of the second side thereof.

2. Printing apparatus according to claim 1 wherein the sheet inverter positively controls the position of the sheet during the sheet during the inversion thereof, without releasing the sheet during the inversion.

3. Apparatus according to claim 1 wherein said impression roller and said sheet inverter hold no more than two sheets at any one time.

4. Duplex printing apparatus according to claim 1 wherein the sheet inverter comprises:

a paper pick-off system which removes the sheet from the impression roller, after printing of the first side of the sheet, while the sheet is held referenced to said first edge;

an inverting transport past which the first edge is carried while the sheet remains referenced to said first edge; and a sheet pick-off on said inverting transport which captures a second edge of the sheet, opposite the first edge while the sheet is still being held referenced to the first edge, such that said capture is made referenced to the first edge, said inverting transport transporting the second edge to the impression roller for capture by the impression roller, such that the second side of the sheet is present for printing by the imager.

5. Apparatus according to claim 4 and including at least one intermediate transport which receives the sheet from the sheet pick-off and transports it to the inverting transport while the sheet remains referenced to the first edge.

6. Apparatus according to claim 5 wherein the at least one intermediate transport comprises at least one roller.

7. Apparatus according to claim 5 wherein a sheet path in the paper pick-off system, sheet pick-off and intermediate transport is at least the length of a plurality of sheets.

8. Apparatus according to claim 4 wherein the paper pick-off system comprises at least one vacuum pick-off that picks the sheet off the impression roller and holds it while it is being inverted.

9. Apparatus according to claim 8 wherein the at least one vacuum pick-off comprises two sets of vacuum pick-offs each comprising at least one pick-off, wherein the vacuum pick-offs pick offs alternate in picking sheets off the impression roller.

10. Apparatus according to claim 8 and including a belt transport that receives a sheet from the at least one vacuum pick-off and transports it to the impression roller while positively holding the sheet referenced to the image printed on the first side.

11. Apparatus according to claim 4 wherein the vacuum pick-offs rotate about an axis and have a radial extent from the axis and including at least one at least partial disks concentric with the axis and having a radial extent equal to the radial extent of the vacuum pick-offs.

12. Apparatus according to claim 1 wherein the sheet inverter comprises a transport roller.

13. Duplex printing apparatus according to claim 1 wherein the sheet inverter comprises a turn-over roller for sheet inversion.

14. Apparatus according to claim 1 wherein the sheet inverter stops the motion of the sheet while positively holding it referenced to the printing on the first side and then moves the sheet in a reverse direction for capture by the impression roller.

15. Apparatus according to claim 1 wherein said impression roller and said sheet inverter hold no more than two sheets at any one time.

16. Apparatus according to claim 1 in which the imager comprises a plurality of imaging stations each of which transfers an image of a different color to the sheet.

17. Apparatus according to claim 1 in which the imager includes an image forming surface on which the image is formed prior to transfer to the sheet.

18. Apparatus according to claim 17 wherein the imager includes at least one intermediate transfer member to which images are transferred from the image forming surface and from which the images are transferred to the sheet.

19. Apparatus according to claim 1 wherein the imager provides different images to the sides of the sheet.

20. Apparatus according to claim 1 wherein the imager is an electrographic imager.

21. Apparatus according to claim 1 wherein the imager is a powder toner imager.

22. Apparatus according to claim 1 wherein the imager is a liquid toner imager.

23. Apparatus according to claim 1 wherein the imager is an ink-jet or bubble jet imager.

24. Apparatus according to claim 1 wherein the impression roller is adapted to hold a plurality of sheets at one time.

25. Duplex printing apparatus for printing on two sides of a sheet, the apparatus comprising:

an impression roller on which the sheet is held during printing, referenced to a first edge thereof;

an imager which prints an image on first side of the sheet while it is being held on the impression roller; and a sheet inverter which removes the sheet from the impression roller, inverts the sheet and returns it to the impression roller for printing on a second side of the sheet by the imager, wherein the sheet inverter positively controls the position of the sheet from the removal of the sheet from the impression roller to the return of the sheet thereof after the inversion thereof, without releasing the sheet.

26. Duplex printing apparatus according to claim 25 wherein the sheet inverter comprises: p1 a paper pick-off system which removes the sheet from the impression roller, after printing of the first side of the sheet, while the sheet is held referenced to said first edge;

an inverting transport past which the first edge is carried while the sheet remains referenced to said first edge; and a sheet pick-off on said inverting transport which captures a second edge of the sheet, opposite the first edge while the sheet is still being held referenced to the first edge, such that said capture is made referenced to the first edge, said inverting transport transporting the second edge to the impression roller for capture by the impression roller, such that second side to the sheet is present for printing by the imager.

27. Apparatus according to claim 26 and including at least one intermediate transport which receives the sheet from the sheet pick-off and transports it to the inverting transport while the sheet remains referenced to the first edge.

28. Apparatus according to claim 27 wherein the at least one intermediate transport comprises at least one roller.

29. Apparatus according to claim 27 wherein a sheet path in the paper pick-off system, sheet pick-off and intermediate transport is at least the length of a plurality of sheets.

30. Apparatus according to claim 26 wherein the inverting transport comprises a transport roller.

31. Apparatus according to claim 26 wherein the paper pick-off system comprises at least one vacuum pick-off that picks the sheet off the impression roller and holds it while it is being inverted.

32. Apparatus according to claim 31 wherein the at least one vacuum pick-off comprises two sets of vacuum pick-offs each comprising at least one pick-off, wherein the vacuum pick-offs pick offs alternate in picking sheet off the impression roller.

33. Apparatus according to claim 31 and including a belt transport that receives a sheet from the at least one vacuum pick-off and transports it to the impression roller while positively holding the sheet referenced to the image printed on the first side.

34. Apparatus according to claim 31 wherein the vacuum pick-offs rotate about an axis and have a radial extent from the axis and including at least one at least partial disk concentric with the axis and having a radial extent equal to the radial extent of the vacuum pick-offs.

35. Duplex printing apparatus according to claim 25 wherein the sheet inverter comprises a turn-over roller for sheet inversion.

36. Apparatus according to claim 25 wherein the sheet inverter stops the motion of the sheet while positively holding it referenced to the printing on the first side and then moves the sheet in a reverse direction for capture by the impress roller.

37. Apparatus according to claim 25 in which the imager comprises a plurality of imaging stations each of which transfers an image of a different color to the sheet.

38. Apparatus according to claim 25 in which the imager includes an image forming surface on which the image is formed prior to transfer to the sheet.

39. Apparatus according to claim 38 wherein the imager includes at least one intermediate transfer member to which images are transferred from the image forming surface and from which the images are transferred to the sheet.

40. Apparatus according to claim 25 wherein the imager provides different images to the sides of the sheet.

41. Apparatus according to claim 25 wherein the imager is an electrographic imager.

42. Apparatus according to claim 25 wherein the imager is a powder toner imager.

43. Apparatus according to claim 25 wherein the imager is a liquid toner imager.

44. Apparatus according to claim 25 wherein the imager is an ink-jet or bubble jet imager.

45. Apparatus according to claim 25 wherein the impression roller is adapted to hold a plurality of sheets at one time.

46. A duplex printing method for printing on two sides of a sheet, the method comprising:

printing an image on a first side of the sheet at a printing position, the sheet and thus said printing being referenced to a first edge thereof;

inverting the sheet and returning it to the printing position while it remains referenced to said first edge; and printing an image on a second side of the sheet at said printing position while the sheet and thus said printing is referenced to said first edge.

47. A printing method according to claim 46 wherein the position of the sheet is positively controlled during the step of inversion, without releasing the sheet between printing of the first and second sides thereof.

48. A method according to claim 46 wherein the sheet is delivered to said printing position by a moving member on which the sheet is held while being referenced to said first edge.

49. A method according to claim 48 wherein said sheet is printed while being moved by the moving member past the printing position and wherein the sheet is held at said first edge during printing of one side thereof and held by an opposite edge of the sheet during printing of the other side thereof.

50. A method according to claim 48 wherein said sheet is printed while being moved past the printing position with said first edge passing the position ahead of the sheet during printing of one side of the sheet and wherein said first edge passes the printing position after the rest of the sheet during the printing of the other side of the sheet.

51. A method according to claim 46 and including printing different images on the two sides of the sheet.

52. A method according to claim 46 wherein inverting the sheet includes:

moving the sheet to a first position while holding it referenced to the first edge;

stopping it at the first position; and returning it to the printing position while it remains referenced to the first edge.

53. A duplex printing method for printing on two sides of a sheet, the method comprising:

printing an image on a first side of the sheet at a printing position, the sheet and thus said printing being referenced to a first edge thereof;

inverting the sheet and returning it to the printing position; and printing an image on a second side of the sheet at said printing position, wherein the position of the sheet is positively controlled during printing and inversion thereof, without releasing the sheet, such that the printing on the second side thereof is referenced to the first edge.

54. A method according to claim 53 wherein the sheet is delivered to said printing position by a moving member on which the sheet is held while being referenced to said first edge.

55. A method according to claim 54 wherein said sheet is printed while being moved by the moving surface past the printing position and wherein the sheet is held at said first edge during printing of one side thereof and held by an opposite edge of the sheet during printing of the other side thereof.

56. A method according to claim 54 wherein said sheet is printed while being moved past the printing position with said first edge passing the position ahead of the sheet during printing of one side of the sheet and wherein said first edge passes the printing position after the rest of the sheet during the printing of the other side of the sheet.

57. A method according to claim 53 and including printing different images on the two sides of the sheet.

58. A method according to claim 53 wherein inverting the sheet includes:

moving the sheet to a first position while holding it referenced to the first edge;

stopping it at the first position; and returning it to the printing position while it remains referenced to the first edge.

* * * * *